United States Patent [19]

Takahashi et al.

[11] 4,115,117

[45] Sep. 19, 1978

[54] COLOR DIFFUSION TRANSFER PROCESS EMPLOYING PHOSPHORAMIDES

[75] Inventors: Jiro Takahashi; Akihiko Miyamoto; Tooru Aoki; Naoshi Kunieda; Kuniaki Tanisawa, all of Hino, Japan

[73] Assignee: Konishiroku Photo Industry Co., Ltd., Tokyo, Japan

[21] Appl. No.: 739,302

[22] Filed: Nov. 5, 1976

[30] Foreign Application Priority Data

Nov. 7, 1975 [JP] Japan ..... 50-134569
Apr. 16, 1976 [JP] Japan ..... 51-43213

[51] Int. Cl.[2] ..... G03C 7/00; G03C 5/54; G03C 1/40

[52] U.S. Cl. ..... 96/29 D; 96/3; 96/77

[58] Field of Search ..... 96/3, 29 D, 77, 97, 96/99, 100; 260/551 P

[56] References Cited

U.S. PATENT DOCUMENTS 2,983,606 5/1961 Rogers ..... 96/29 D
3,253,915 5/1966 Weyerts et al. ..... 96/29 D

OTHER PUBLICATIONS

Fleckenstein et al., U.S. Published Application Voluntary Trial Protest No. B 351,673 1/1975.

*Primary Examiner*—Richard L. Schilling
*Attorney, Agent, or Firm*—Jordan B. Bierman; Linda G. Bierman; Kenneth J. Stempler

[57] ABSTRACT

An improved process for forming a dye image in an image receiving layer of a film unit containing a light-sensitive element and an image receiving element by incorporation therein of a compound represented by the formula wherein $R_1$ and $R_2$ individually represent lower alkyl, and $n$ is 3.

12 Claims, No Drawings

COLOR DIFFUSION TRANSFER PROCESS EMPLOYING PHOSPHORAMIDES

This invention relates to a color diffusion transfer process. More particularly, the invention relates to a color diffusion transfer process in which the maximum density of an image formed thereby is increased and the processing time necessary therefor is shortened.

A color diffusion transfer process is well known as a method of forming color images. This process involves various modes of practice which may be diversified from each other according to the manner of releasing a diffusible dye from a color image-forming substance at the time of development of a silver halide. A first one, typical of such modes, is the so-called dye developer method, wherein a dye developer that is a compound comprising in one molecule thereof both a chromophore moiety and a moiety having a silver halide developing function is used as a color image-forming substance and, as a result of oxidation of the dye developer during development of a silver halide image, the oxidized dye developer comes to change in its diffusibility. The color diffusion transfer process of this mode has been described in many patents, for example, British Pat. No. 804,971. In this process, a light-sensitive element containing a silver halide emulsion and a diffusible dye developer is exposed to light, whereby a latent image is formed in the silver halide, and the exposed light-sensitive element is then treated with an alkaline processing solution. During processing the light-sensitive element with the alkaline processing solution, said element is placed upon an image-receiving element capable of mordanting the dye developer, and unoxidized diffusible dye developers in imagewise distribution are transferred by diffusion to the image-receiving element, thereby to obtain a positive dye image thereon.

A second one, typical of the aforesaid various modes, is a process wherein a nondiffusible coupler is used as the color image-forming substance and the oxidized product of a color developing agent formed during development of a silver halide image reacts with the coupler, thereby to release a diffusible dye.

The color diffusion transfer process of this mode has been disclosed, for example, in U.S. Pat. Nos. 3,227,550; 3,443,940 and 3,734,726; British Pat. No. 904,365; Japanese Laid-Open-to-Public Publication No. 2,327/1972; U.S. Pat. No. 3,705,035; Japanese patent publication No. 39,165/1973; Japanese Laid-Open-to-Public publication Nos. 64,436/1974 and 123,032/1974.

A third typical one is a process in which a nondiffusible color image-forming substance (a redox compound) is oxidized and then the oxidized substance cleaves in an alkaline solution or undergoes an intramolecular ring closure reaction, thereby to release a diffusible dye.

The color diffusion transfer process of this mode has been disclosed, for example, in U.S. Pat. Nos. 3,698,897; 3,725,062; 3,728,113; 3,245,789 and 3,443,939; Japanese Laid-Open-to-Public publication Nos. 33,826/1973 and 118,723/1975.

Further, a fourth typical one is a process in which a color image-forming substance is used, which substance releases a diffusible dye upon its cleavage in an alkaline solution, but the cleavage does not substantially take place when an oxidized developing agent is present in the system. The color diffusion transfer process of this mode has been disclosed, for example, in Japanese Laid-Open-to-Public publication No. 111,628/1974.

In the aforementioned dye developer color diffusion transfer process, a dye developer to be transferred by diffusion is required to be sufficiently dissolved in an alkaline processing solution and, moreover, an oxidiation product of the dye developer formed in the development reaction is required to become substantially insoluble in the processing solution. In general, a dye developer is dissolved by use of such a high boiling solvent, for example, as diethyllaurylamide disclosed in Japanese patent publication No. 1,738/1964, and the dye developer solution is then dispersed in a gelatin colloid solution to form a dispersion of fine-grained dye developer, or is directly dispersed in a gelatin colloid solution in such a manner as disclosed in Japanese patent publication No. 32,131/1973 and U.S. Pat. No. 3,832,173. Since the dye developer in such dispersed form as mentioned above is incorporated into a light-sensitive element, the dye developer starting from its fine-grained state has to be eluted into a processing solution when the light-sensitive element is subjected to development treatment after imagewise exposure. As the processing solution usable in such case, there have been known alkaline processing solutions which contain, for example, alkali metal hydroxides. When the development treatment was conducted by the use of these processing solutions, however, there were observed such drawbacks that a dye developer in the fine grain state was not sufficiently eluted into the processing solution so that the transfer rate slowed down and the maximum density of an image formed thereby decreased. Furthermore, in the case of using the aforementioned processing solutions to treat such dye developer as hydrolyzable dye developers disclosed in Japanese patent publication No. 379/1961, or shorter-wavelength-shift dye developers or leuco-dye developers, there were observed similarly such drawbacks that the transfer rate slowed down and the maximum density of an image formed thereby decreased.

Such drawbacks that the maximum density of an image formed is not deemed so satisfactorily high and the processing speed is not so fast enough are likewise observed in any mode of the color diffusion transfer system; that is, the above-mentioned third mode of the photographic system where the redox compound capable of being oxidized to release a diffusible dye on ring closure or on decomposition with alkali is used as a color image-forming substance; the above-mentioned second mode of the photographic system where a coupler capable of reacting with an oxidation product of an aromatic primary amine color developing agent, thereby to release a diffusible dye is used as a color image-forming substance; and the above-mentioned fourth mode of the photographic system.

An object of the present invention is to eliminate the above-mentioned drawbacks and is to provide a color diffusion transfer process using a light-sensitive element containing a dye image-forming substance, wherein the maximum density of an image formed is enhanced and the transfer rate is accelerated.

Such object and other objects of the present invention which will be mentioned hereinafter may be accomplished by applying an alkaline processing solution to both the imagewise exposed light-sensitive element containing a color image-forming substance and the image-receiving element placed upon said light-sensitive element, in the presence of a compound represented by undermentioned general formula [I], and then transferring from said light-sensitive element a diffusible dye released from said color image-forming substance correspondingly to the imagewise exposure onto said image-receiving element, thereby to form a color dye image thereon.

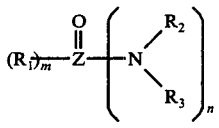

[I]

wherein Z represents carbon or phosphorus; $R_1$ represents hydrogen or lower alkyl (preferably methyl or ethyl); $R_2$ and $R_3$, which may be the same or different, individually represent lower alkyl (preferably methyl or ethyl); $m$ is 0 or 1; and $n$ is 1, 2 or 3; and when Z is carbon atom, $m = 1$ and $n = 1$ or $m = 0$ and $n = 2$; and when Z is phosphorus atom, $m = 0$ and $n = 3$; and when Z is carbon atom and simultaneously when $m = 1$ and $n = 1$, $R_1$ and $R_2$ may be bonded together to form a lactam ring (preferably γ-lactam), together with

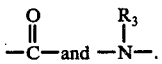

At least while the alkaline processing solution is used in the development treatment according to the present invention, the aforesaid light-sensitive element and image-receiving element are contacted with each other. Both elements may be separated before and/or after the development treatment.

The light-sensitive element of the present invention comprises a silver halide emulsion and a color image-forming substance.

The silver halide emulsion is a hydrophilic colloidal dispersion of silver halide including silver bromide, silver iodide, silver chloride, silver iodobromide, silver chlorobromide, silver chloroiodide, silver chloroiodobromide and their mixtures, and can be prepared by various processes, for example, any of the processes for preparing the so-called conversion emulsions, Lippmann's emulsions, direct positive emulsions which have previously been fogged or which are of the internal latent image type, and the like. Grain size, content and mixing ratio of the silver halides are selected within a wide range according to the kind of the desired light-sensitive photographic materials used. As the hydrophilic protective colloid which is a dispersant for the silver halide, there may be used various natural or synthesized colloid substances either alone or in combination, such as gelatin, gelatin derivatives, polyvinyl alcohol and the like. Such silver halide as explained above can be chemically sensitized by the use of active gelatin; such sulfur sensitizers as allylthiocarbamide, thiourea and cystine and the like; selenium sensitizers; such noble metal sensitizers as gold sensitizer, ruthenium, rhodium and irridium sensitizers, which sensitizers may be used either singly or suitably in combination. Further, the silver halide emulsion may be optically sensitized, for example, by the use of cyanine dyes or merocyanine dyes and thus color light-sensitive elements can usually be prepared from three kinds of silver halide emulsions having their respective light-sensitive wavelength regions different from each other.

This silver halide emulsion may also be stabilized by the use of triazoles, azaindenes, quaternary benzothiazolium compounds, zinc or cadmium compounds, and may also contain a sensitizing compound of quaternary ammonium salt type or of polyethylene glycol type. The emulsion may further contain suitable plasticizers for gelatin, such as glycerine; dihydroxyalkane, e.g. 1,5-pentanediol; ester of ethylenebisglycolic acid; bis-ethoxydiethylene glycol succinate; amide of such acid as acrylic acid; or latex; and may also contain gelatin-hardeners such as formaldehyde; a halogen-substituted fatty acid, e.g. mucobromic acid; compounds having acid anhydride groups; dicarboxylic acid chloride; diester of methanesulfonic acid; or sodium bisulfite derivatives of dialdehyde in which the aldehyde groups are separated by 2 to 3 carbon atoms. Further, the emulsion may contain various additives for photographic purposes, for example, such wetting agent as saponin or such coating aid as sulfosuccinate. Still further, the emulsion may contain, if necessary, various additives commonly used in the art of photography, such as anti-foggants, ultraviolet absorbers or the like.

The light-sensitive element of the present invention comprises therein the above-mentioned silver halide emulsion in combination with a color image-forming substance. In the present invention, various kinds of color image-forming substances may be used according to the mode of process employed therefor.

The first typical class of color image-forming substances is a dye developer. The dye developers contain both a chromophore moiety and at least one moiety having a silver halide developing function, such as a hydroquinonyl radical. The latter moiety imparts silver halide-developing activity to the dye developer molecule as a whole, and so, during development of a silver halide image, the dye developers are oxidized to be less diffusible compounds and the residual dye developers in the undeveloped regions are transferred imagewise, as dyes, diffusible dyes, to an image-receiving layer, to provide a dye image therein.

As representative dye developers used in the present invention, there may be mentioned, for example, such compounds as disclosed in the specifications of U.S. Patents represented by their respective patent numbers, i.e. U.S. Pat. Nos. 2,983,606; 3,345,163; 3,255,001; 3,218,164; 3,135,606; 3,421,892; 3,453,107; 3,551,406; 3,597,200; 3,563,739; 3,482,972; 3,415,644 and 3,594,165.

In the present invention, furthermore, there may be used also hydrolyzable dye developers. These dye developers have hydrolyzable groups in their molecules, so that, as a result of the development, the hydrolizable groups are cleaved off by hydrolysis, and the hydrolyzed form of the dye developers are, as diffusible dyes, transferred to the image-receiving layer to provide a dye image therein. Among these dye developers, there is also known a shorter-wavelength-shift dye developer, which has, on the chromophore moiety, a hydrolyzable group, which has the effect of shifting the visible absorption toward the shorter wavelength, such as an acyl radical attached to the chromophore moiety through nitrogen or oxygen. In this case, the dye developers change in structure and color during development, and the changed form of the dye developer which has a color different from that of the dye developer originally present in the sensitive element is transferred, as a diffusible dye, to the image-receiving layer to provide a dye image therein. Typical examples of such dye developers include, for example, such compounds as disclosed in U.S. Pat. Nos. 3,230,082; 3,329,670; 3,307,947; 3,230,083; 3,230,084; 3,230,085; 3,579,334; 3,295,973; 3,196,014 and 3,336,287; British Patent Nos. 1,138,630 and 1,129,370; Japanese Laid-Open-to-Public publications Nos. 26,541/1975; 78,327/1975; 83,033/1975 and 110,634/1975; and U.S. patent application Ser. Nos. 709,936(1976) and 709,548(1976).

Further, such leuco dye developers, for example, as disclosed in U.S. Pat. No. 2,909,430 and U.S. patent application Ser. Nos. 206,836(1971), 308,869(1972), 206,924 to 206,927(1971) and 206,949(1971), and Japanese-Laid-Open-to-Public publication No. 91,324/1975, may also be advantageously usable in the present invention. Leuco dye developers are immobilized in the developed regions and imagewise diffuse, as diffusible dyes, from the undeveloped regions to the image-receiving layer, and are oxidized to form a colored dye image therein.

Examples of these dye developers disclosed in the above patents or publications are:

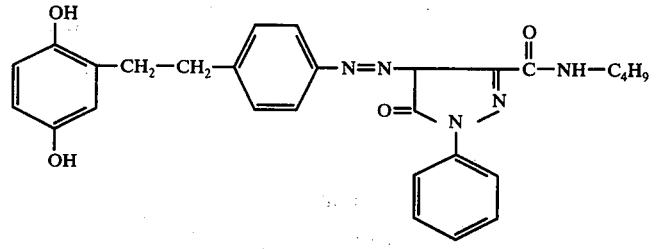

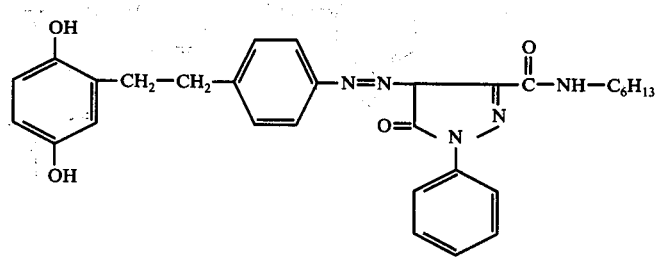

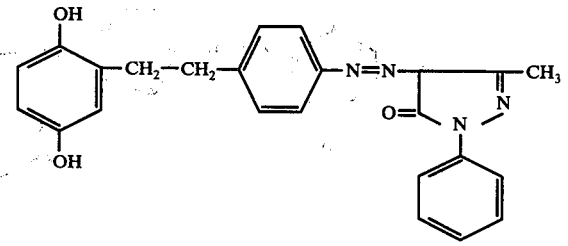

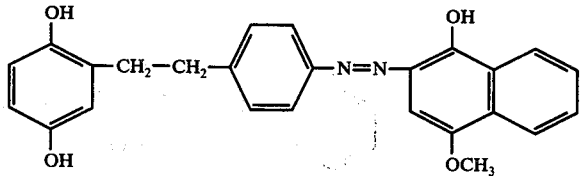

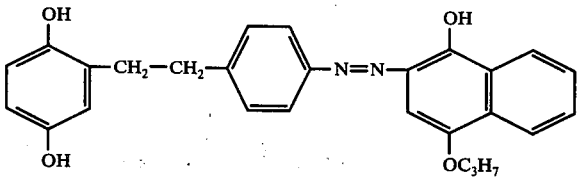

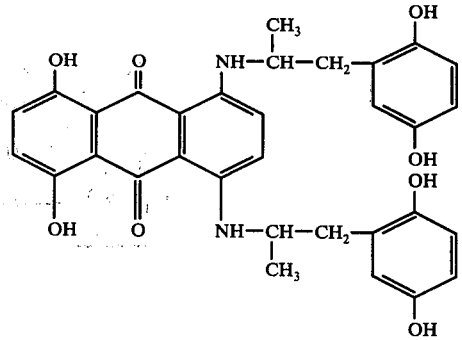

-continued
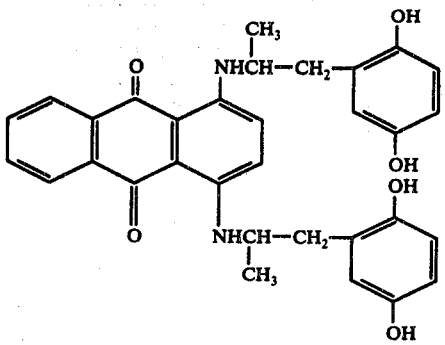
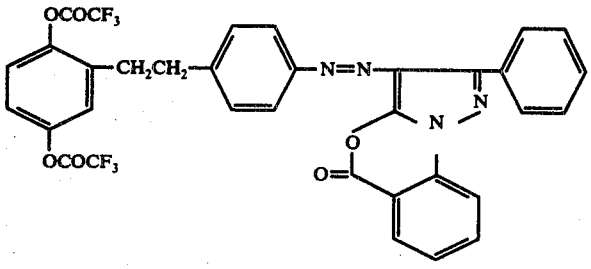
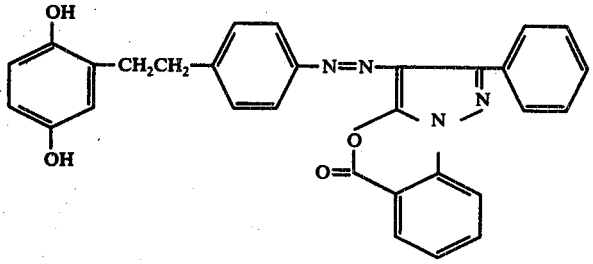
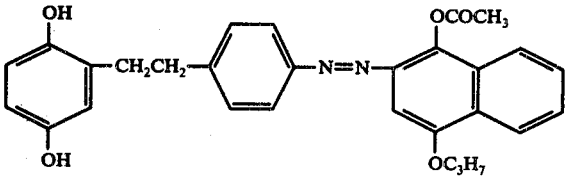
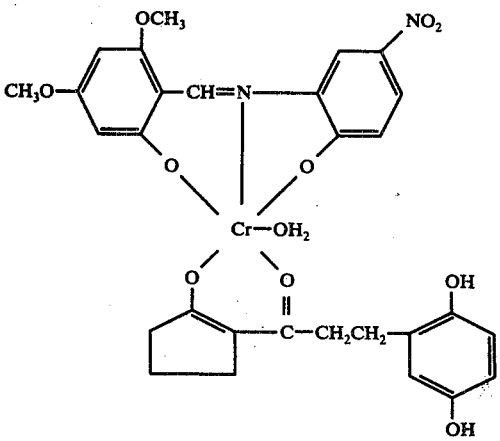

-continued
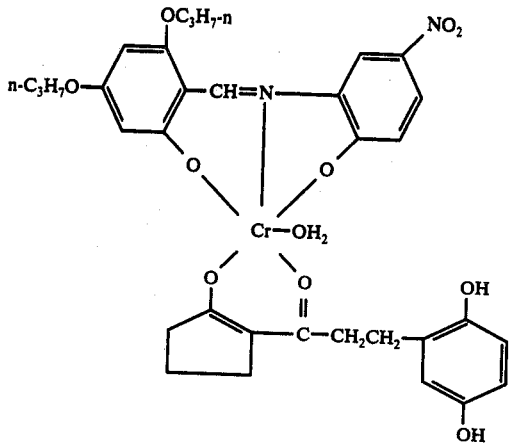
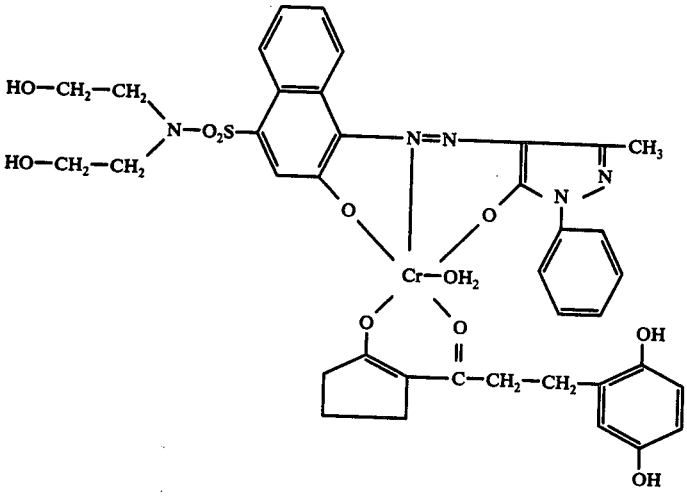
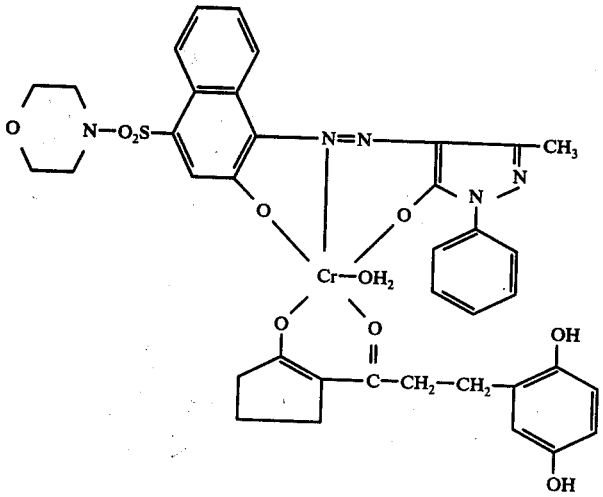

-continued
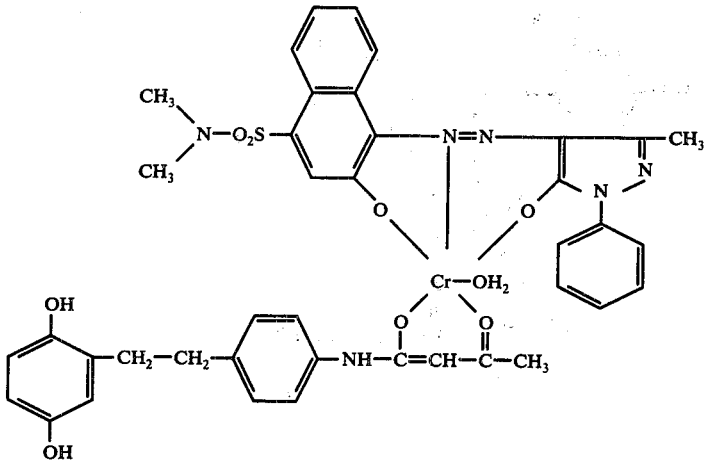
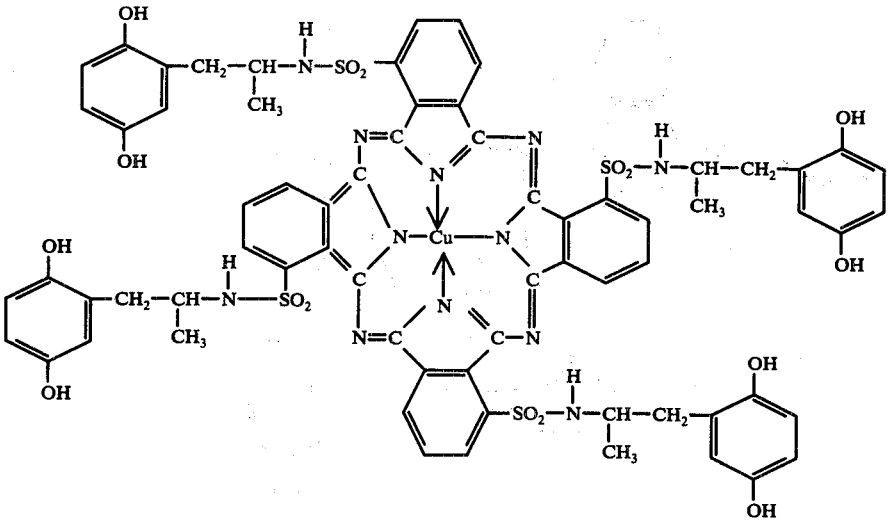
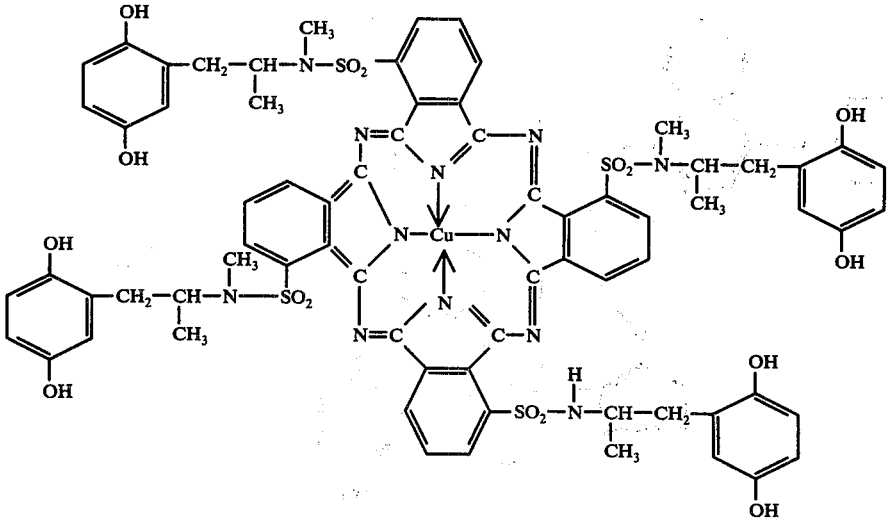

-continued

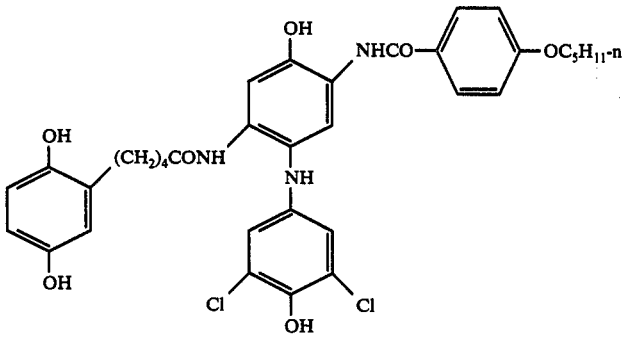

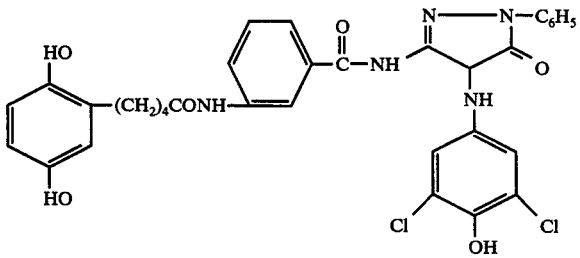

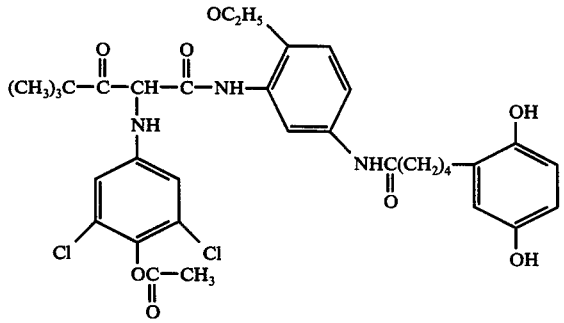

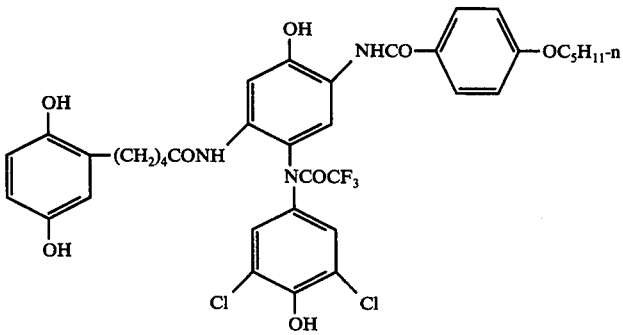

Dye developers are synthetized according to the synthetic methods of the patents or the publications cited above.

The second typical class of color image-forming substances is a non-diffusible coupler which releases a diffusible dye by coupling reaction with an oxidized color developing agent or by a ring closure reaction subsequent to the coupling reaction.

As the former type of the non-diffusible couplers, that is, the non-diffusible couplers which react with oxidation products of aromatic primary amine developing agents, thereby to release diffusible dyes, there may be mentioned, for example, such compounds as disclosed in British Pat. Nos. 840,731; 904,364 and 904,365; and U.S. Pat. No. 3,227,550.

Further, as the latter type of the non-diffusible couplers, that is, the couplers which couple with oxidation products of aromatic primary amine developing agents and then undergo ring closure reaction, thereby to release diffusible dyes, for example, as disclosed in U.S. Pat. Nos. 3,443,939; 3,751,406; 3,443,940 and 3,734,726 can also be effectively usable as color image-forming substances in the present invention.

These non-diffusible couplers are synthetized according to the disclosure of these patents.

Examples of these non-diffusible couplers disclosed in the above patents are:

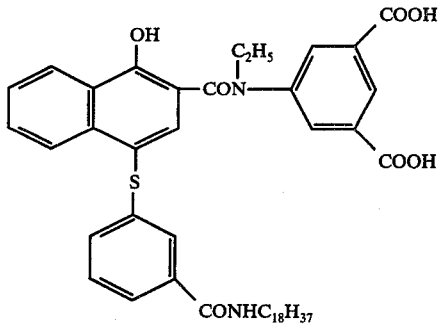
OH
$C_2H_5$
CON
COOH
COOH
S
$CONHC_{18}H_{37}$
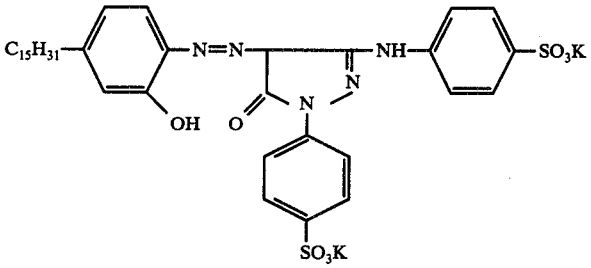
$C_{15}H_{31}$
N=N
NH
$SO_3K$
N
N
OH
O
$SO_3K$
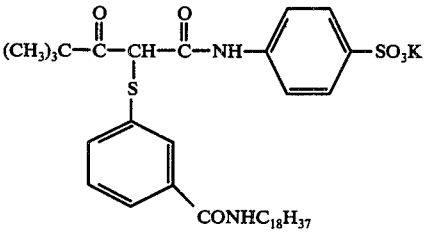
O
O
$(CH_3)_3C$
C
CH
C
NH
$SO_3K$
S
$CONHC_{18}H_{37}$
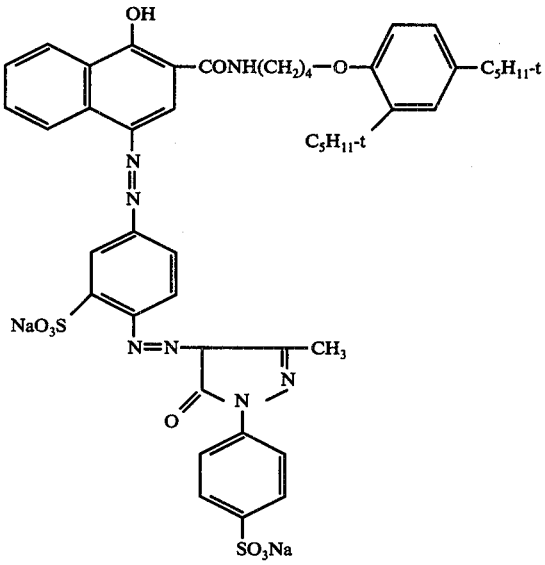
OH
$CONH(CH_2)_4$
O
$C_5H_{11}$-t
$C_5H_{11}$-t
N
N
$NaO_3S$
N=N
$CH_3$
N
N
O
$SO_3Na$
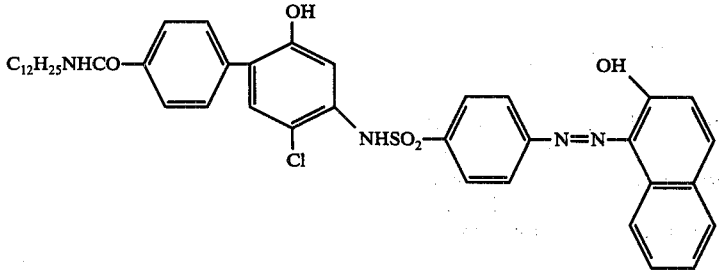
OH
$C_{12}H_{25}NHCO$
OH
Cl
$NHSO_2$
N=N Third typical class of the color image-forming substances is a non-diffusible redox compound capable of being oxidized to cleave in an alkaline solution or oxidized to undergo an intramolecular ring closure reaction, thereby to release a diffusible dye. Such non-diffusible redox compound as disclosed in U.S. Pat. No. 3,928,312; U.S. patent application Ser. No. 351,673 which has been published for opposition purpose as trial voluntary protest No. B351,673; U.S. Pat. Nos. 3,929,760, 3,942,987, 3,931,144, 3,932,381 and 3,932,380; U.S. patent application Ser. No. 439,809, now U.S. Pat. No. 3,954,476; Research Disclosure 13024 (1975. 2. 7); West German Laid Open-to-Public publication Nos. 2,406,664 and 2,505,248 and U.S. Pat. Nos. 3,443,940, 3,443,943 and 3,751,406 can be used as the color image forming substance in the present invention.

Among these non-diffusible redox compounds, the former type, that is, the redox compound not undergoing the ring closure reaction, can be preferably used in the present invention. Further, more desirable redox compounds in the present invention are represented by the following formula:

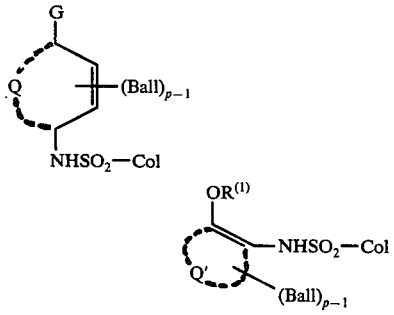

-continued

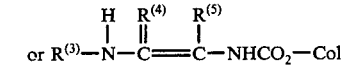

wherein Col is a dye or dye precursor moiety; Ball is an organic ballasting radical of such molecular size and configuration as to render the compound non-diffusible during development in an alkaline processing solution; G is OR$^{(1)}$ or NHR$^{(2)}$; R$^{(1)}$ is hydrogen or a hydrolyzable moiety; R$^{(2)}$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when R$^{(2)}$ is an alkyl group of greater than 6 carbon atoms, it can serve as a partial or sole ballast group); p is a positive integer of 1 to 2 and is 2 when G is OR$^{(1)}$ or when R$^{(2)}$ is hydrogen or an alkyl group of less than eight carbon atoms; Q is the atoms necessary to complete a benzene, naphthalene or quinoline nucleus including substituted benzene, naphthalene or quinoline; Q' is the atoms necessary to complete a benzene, naphthalene, tetrahydronaphthalene, chromane, pyrazole, pyrrole, or α-quinolone nucleus each of which may have substituents.

R$^{(3)}$, R$^{(4)}$ and R$^{(5)}$ are bonded together to form a substituted or unsubstituted pyrazolobenzimidazole, or R$^{(3)}$ and R$^{(5)}$ are bonded together to form a indole and R$^{(4)}$ represents hydrogen or the above-mentioned Ball, and the pyrazolobenzimidazole or indole carries at least one of the above-mentioned Ball.

Examples of these non-diffusible redox compounds are:

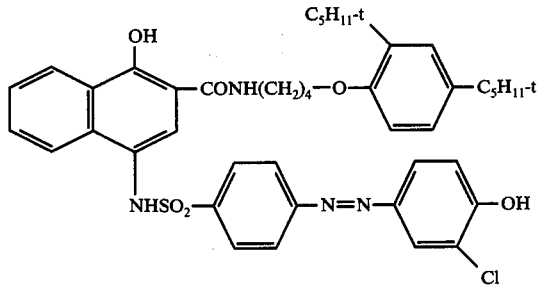

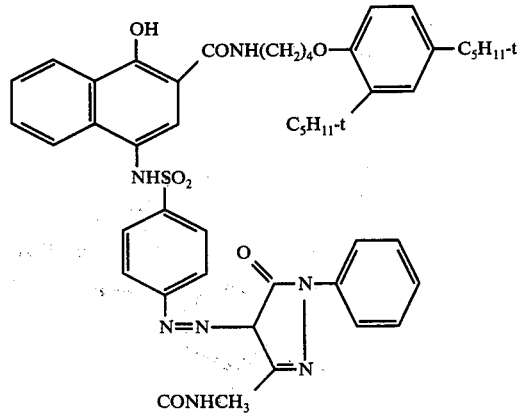

-continued
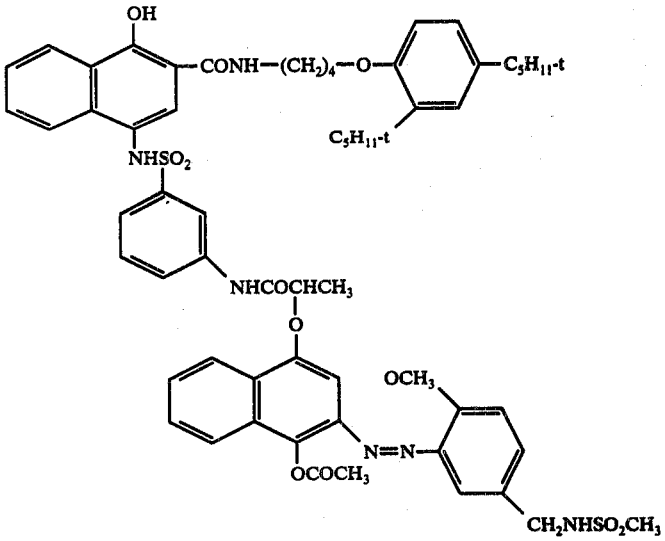
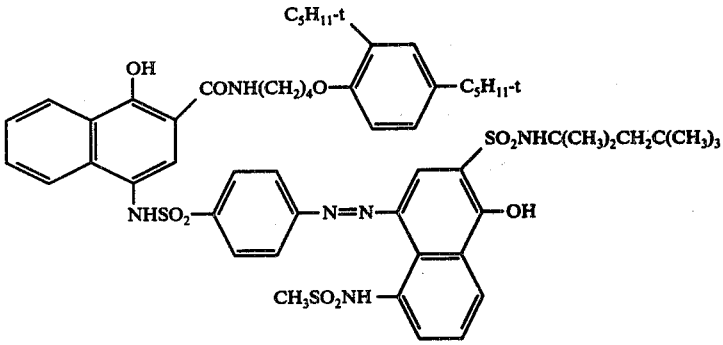
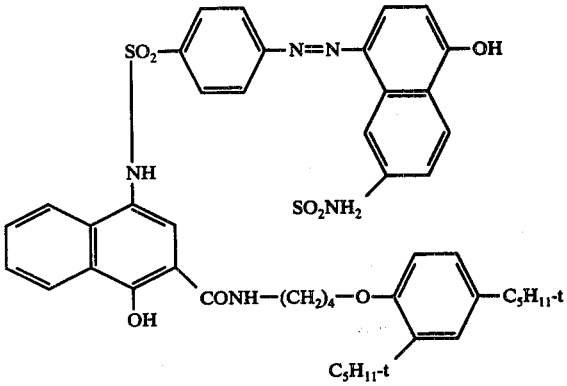
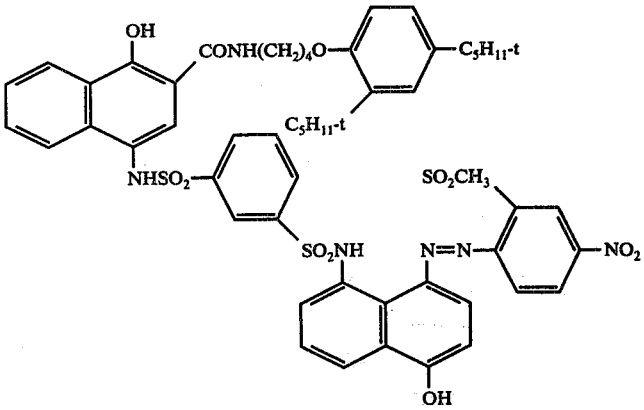

-continued
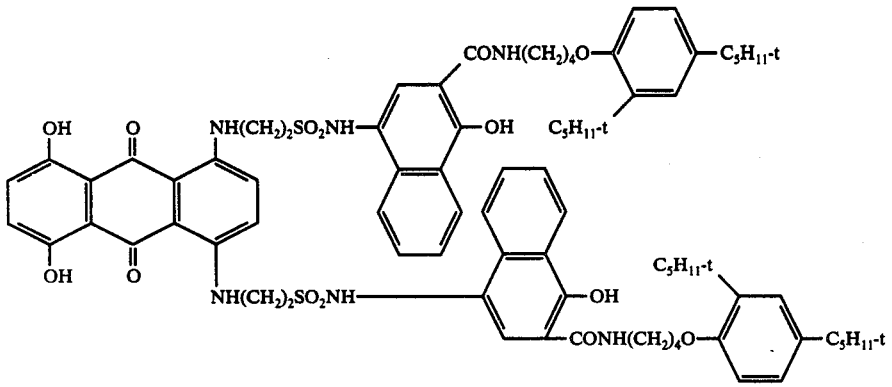
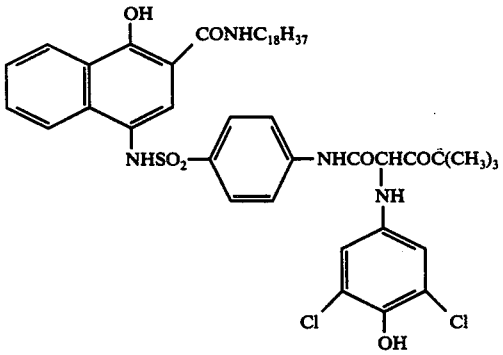
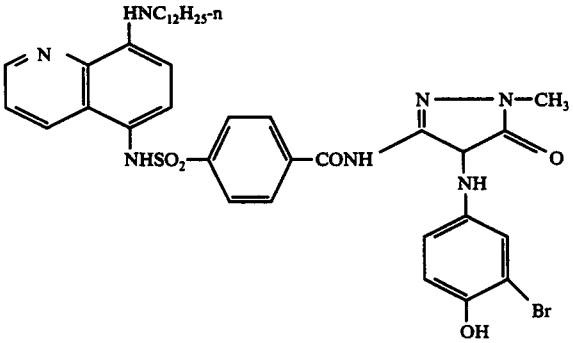
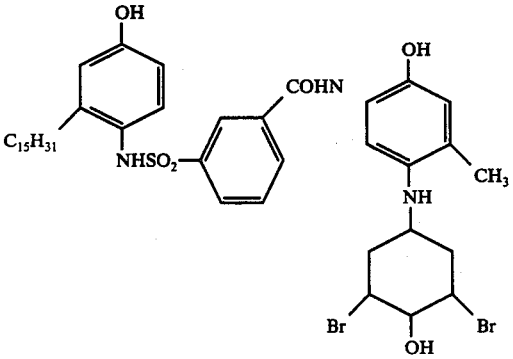

-continued
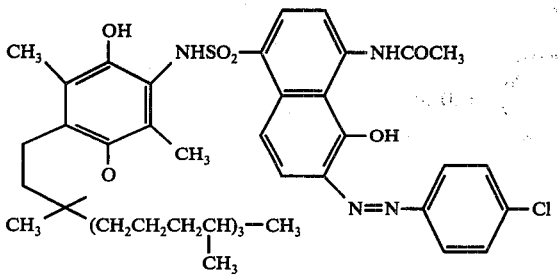
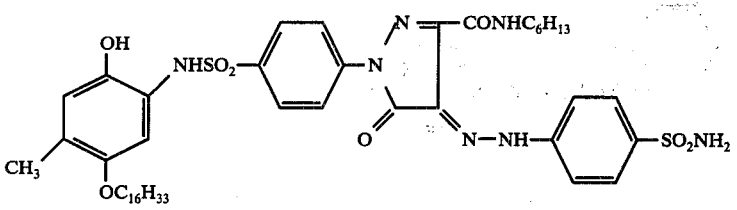
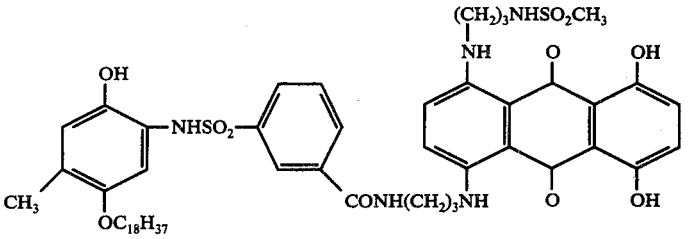
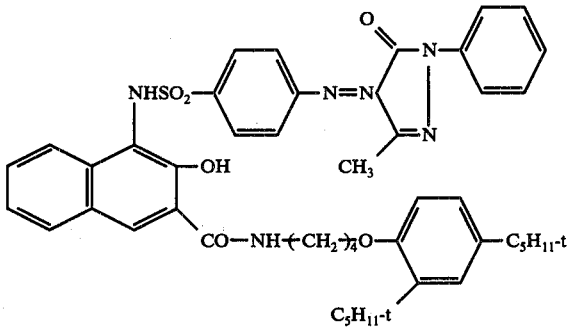
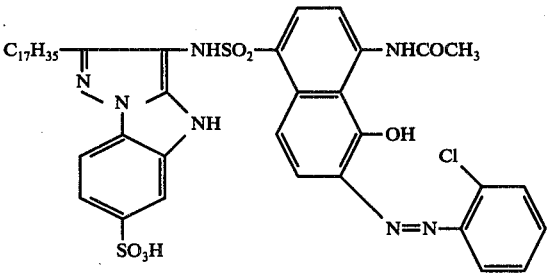
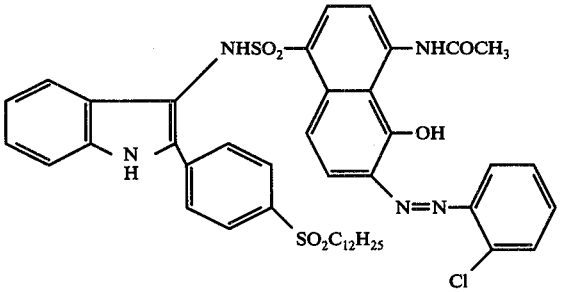

-continued

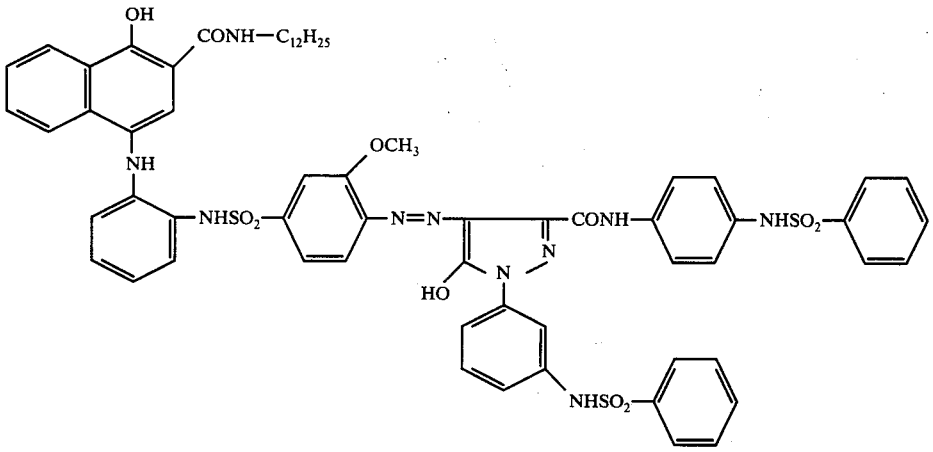

The non-diffusible redox compound mentioned above is synthesized according to the disclosure of the above patents and publications.

Such color image-forming substances as disclosed in U.S. application Ser. Nos. 326,628 filed July 16, 1975, now abandoned, and 511,568, filed Oct. 4, 1974 and now U.S. Pat. No. 3,980,479, may also usable in the present invention, which substance releases a diffusible dye on cleavage in the alkaline solution, and when an oxidized developing agent is present, the substance reacts with the oxidized developing agent before substantial release of the diffusible dye, so that the rate of release of the diffusible dye from the substance is substantially lowered.

Typical examples of such color image-forming substances are:

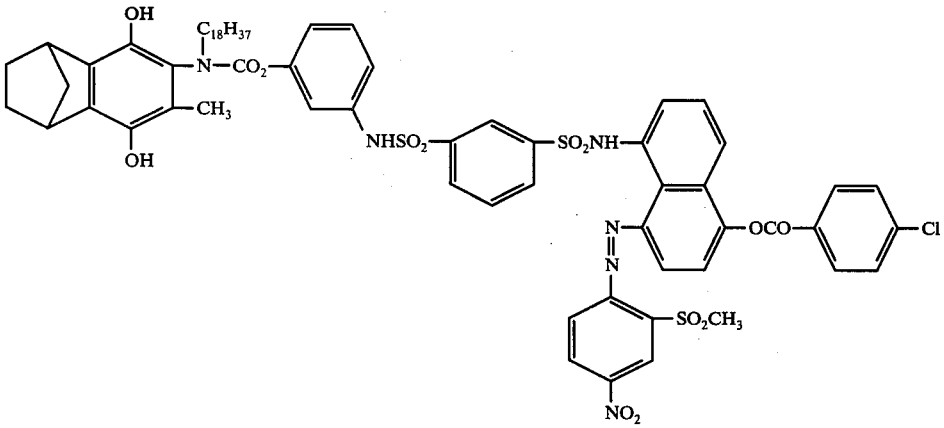

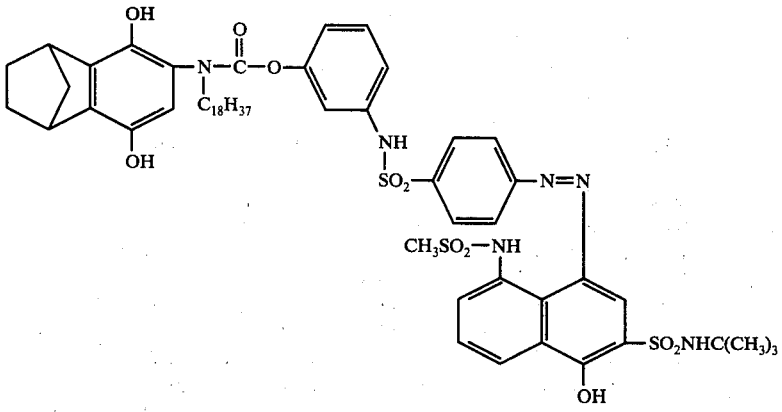

65

-continued

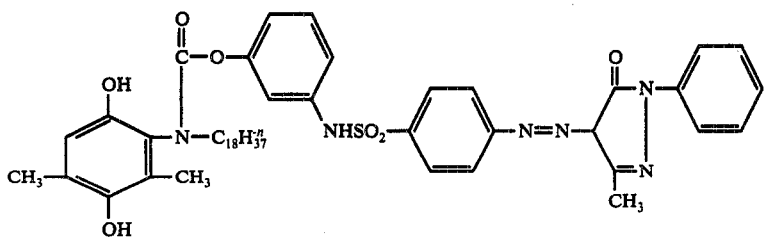

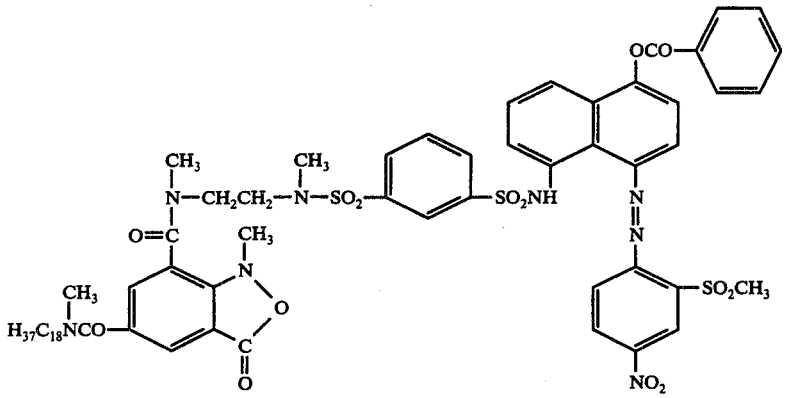

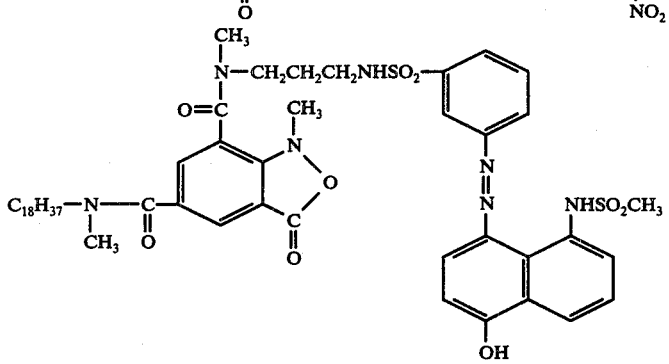

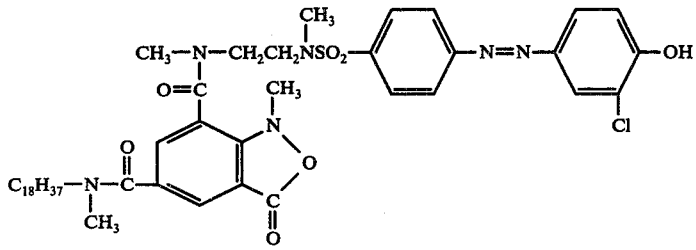

As a chromophore moiety in the above-mentioned color image-forming substances, there may be used various materials such as azo dyes, azomethine dyes, anthraquinone dyes, azine dyes and indophenol dyes. In addition thereto, there may also be used such leuco dyes which are precursors of these dyes mentioned above, for example, as disclosed in Japanese Laid-Open-to-Public publications Nos. 66,440/1974 and 111,628/1974; such shift type dyes, the auxochrome groups of which have been acylated, as disclosed in Japanese patent publication No. 12,393/1961; Japanese Laid-Open-to-Public publications Nos. 111,628/1974 and 115,528/1975; such diazonium compounds as disclosed in Japanese Laid-Open-to-Public publication No. 10,035/1975; and couplers capable of forming dyes on reaction with the oxidation products of color developing agents.

The color image-forming substances are mentioned above in detail. However, when the present invention is carried out in practice, the use of the first class of the substances, i.e. the dye developers; the third class of the substances, i.e. the non-diffusible redox compounds; or the fourth class of the substances, shows, in some cases, a superior effect to that by the second class of substances, i.e. the non-diffusible coupler.

The light-sensitive element comprises therein the aforementioned silver halide emulsions in combination with these color image-forming substances. In case the light-sensitive element is used in a multi-color photographic process according to subtraction method, for example, blue-sensitive green-sensitive and red-sensitive silver halide emulsions are associated with yellow, magenta and cyan color image-forming substances, respectively. Particularly in the dye developer process, it is preferable to use shorter-wavelength-shift dye developers, of which the light absorption spectra have been individually shifted to shorter wavelength. The light-sensitive element having a preferable multi-coated construction is such as coated successively on the surface of a support from the exposure side with a blue-sensitive emulsion, a green-sensitive emulsion and a red-sensitive emulsion in this order, and a yellow filer layer may be provided between the blue-sensitive emulsion and the green-sensitive emulsion. When the light-sensitive silver halide emulsion is used in combination with the color image-forming substance in the light-sensitive element, said emulsion and said substance may be present in separate layers adjacent to each other. Since leuco-type color image-forming substances, shorter-wavelength-shift type color image-forming substances or color image-forming substances as not having a dye structure do not desensitize the emulsion at the time of exposure, such substances may be incorporated into the silver halide emulsion layer. The silver halide emulsion and color image-forming substance may be coated on a support of light-sensitive element to form one layer thereon, for example, according to mixture-packet method disclosed in U.S. Pat. Nos. 2,800,458 and 3,466,662.

The color image-forming substance used in the present invention is generally dissolved in an organic solvent in an amount as small as possible, and the resulting solution is then dispersed in a hydrophilic protective colloid such as gelatin or polyvinyl alcohol which is a carrier for the silver halide emulsion layers or layers adjacent thereto in the light-sensitive element. As the organic solvent for the color image-forming substance, there may be used, either singly or in combination, a high boiling solvent, a low boiling solvent removable by evaporation from a dispersion or a solvent readily miscible with water.

As particularly useful high boiling solvent in the present invention, there may be mentioned N-n-butylacetanilide, diethyllaurylamide, dibutyllaurylamide, dibutyl phthalate, tricresyl phosphate and the like. Useful as low boiling solvents, are ethyl acetate, methyl acetate, 4-methylcyclohexane and the like, and these low boiling solvents may be removed by evaporation at the time of drying after coating layers containing the same.

Various oleophilic polymers may also be usable in place of the high boiling solvents, or may be used additionally in combination with the high boiling solvents. Usable as the oleophilic polymers in the above cases, are polyvinyl acetate, polyacrylates, polyesters obtained from polyhydric alcohols and polybasic acids, and the like.

Such methods as disclosed in Japanese patent publications Nos. 13,837/1968 and 32,131/1973, U.S. Pat. No. 3,832,173 and Japanese Laid-Open-to-Public publication No. 17,637/1975 are useful for the dispersion of color image-forming substances in the present invention.

In the case of color image-forming substances having such water-soluble group as carboxyl or sulfo, the substance is first dissolved in water or in an aqueous alkaline solution and the resulting solution is dispersed in a hydrophilic protective colloid and, if necessary, the resulting dispersion may be neutralized.

The amount of the color image-forming substance used in the present invention may be widely varied according to the kind of compounds used and the desired results. However, the color image-forming substance is preferably used, for example, in an amount of about 0.5 to about 10% by weight based on the weight of a water-soluble organic colloid coating liquid to be coated.

In case a method of tricolor photography is carried out, intermediate layers are advantageously used in the light-sensitive element. The intermediate layer is made of gelatin or/and such hydrophilic polymers as polyacrylamide, partial hydrolyzed polyvinyl acetate and hydroxypropyl cellulose, and sometimes it may be a porous layer formed from a latex of a hydrophilic polymer and a hydrophobic polymer disclosed in U.S. Pat. No. 3,625,685. In order to prevent color mixing caused by diffusion of an oxidized product of a developing agent mentioned below from one layer (wherein the developing agent is oxidized) into other layers, the intermediate layers are preferably incorporated with couplers, amidrazone compounds disclosed in Japanese Laid-Open-to-Public publication No. 15,532/1973 or hydrazone compounds disclosed in West German Pat. No. 2,123,268.

As a support for the light-sensitive element of the present invention, there may be used various materials, for example, papers, glass plates, natural polymers, or synthetic polymers such as cellulose nitrate, cellulose acetate, polyvinyl acetal, polystyrene, polyethylene terephthalate, polypropylene or polyethylene, and these materials may be either transparent or opaque according to the end use thereof.

Also, such supports capable of permeating water vapor as disclosed in U.S. Pat. No. 3,573,044 or supports capable of shutting of oxygen can be advantageously used as those for the light-sensitive element of the present invention. In case a light-sensitive element comprising a transparent support is used, the transparent support is preferably colored to such an extent that an emulsion layer on the support may be prevented during the course of processing from light fog caused by piping of light ray in the support through the end portion of the support, but the support must not hinder exposure of the light-sensitive element and observation of an image.

The light-sensitive element as fully described hereinbefore is preferably placed upon an image-receiving element as will be mentioned hereinafter, and is generally processed by spreading between the two elements an alkaline processing solution of the present invention as will be explained later.

In the case where a dye developer is used as a color image-forming substance, there occurs reduction of silver halide as well as oxidation of the dye developer in the exposed area of a light-sensitive element when an alkaline processing solution is applied to said element, and the oxidized dye developer comes to be more diffusible in the alkaline processing solution and remains immobilized in the neighbourhood of the reduced silver halide crystals. On the other hand, the original dye developer is generally insoluble in acidic or neutral aqueous solutions, and is soluble and diffusible in the alkaline processing solution, and the dye developer present in an unexposed area of the light-sensitive element comes to act, per se, as diffusible dye when the alkaline processing solution is applied thereto. (Accordingly, the term "diffusible dye" as used hereinbefore and hereinafter is defined to include diffusible dyes released or formed from the color image-forming substances as well as original dye developers diffusible in alkali, and the term "diffusible dye" is defined to include leuco dyes and dye precursors in addition to dyes themselves.)

When the aforementioned non-diffusible coupler capable of coupling reaction with an oxidized developing agent is used as a color image-forming substance, a dye soluble and diffusible in an alkaline processing solution is released thereform by coupling reaction of the oxidized developing agent with said coupler, as a result of application of the alkaline processing solution or by a ring-closing reaction subsequent to the coupling reaction.

Further, when a non-diffusible redox compound which undergoes ring closure on oxidation as aforesaid or which cleaves in an alkaline solution to release a diffusible dye is used as a color image-forming substance, there occurs reduction of silver halide as well as oxidation of said redox compound in the exposed portion of light-sensitive element, whereby the oxidized redox compound cleaves off a chromophore moiety or cleaves as a result of the intromolecular ring-closing reaction of the oxidized redox compound, thereby to release a diffusible dye. Alternatively, an alkaline processing solution is applied to a color image-forming substance in the presence of a silver halide-developing agent, thereby to oxidize said agent, and the oxidized agent oxidizes the color image-forming substance and the oxidized color image-forming substance cleaves to release a diffusible dye.

In case the aforementioned color image-forming substance which undergoes cleavage with alkali to release a diffusible dye, but the cleavage does not substantially take place when an oxidized developing agent is present in the system is used in a light-sensitive element, a diffusible dye is not formed in the exposed area because the oxidized developing agent resulting from reduction of a silver halide is present in the system, but in the unexposed area said color forming-substance undergoes cleaveage with alkali to release a diffusible dye because no oxidized developing agent is not present in said unexposed area.

As explained hereinabove, various kinds of color image-forming substances can be used in the light-sensitive element of the present invention. In case of using the color image-forming substance by which a negative dye image is formed as a transferred image when a negative type silver halide emulsion is used, such direct positive type silver halide emulsions, for example, as those disclosed in U.S. Pat. Nos. 3,227,552; 2,592,250; 2,005,837 and 3,367,778 and Japanese patent publication No. 17,184/1966 can be used to obtain a positive image instead. In order to obtain a positive transferred image by use of such substance, there can be employed, alternatively, a physical development process as disclosed in British Pat. No. 904,364 and Japanese Laid-Open-to-Public publication No. 325/1972, or a process as disclosed in Japanese patent publication No. 21,778/1968 in which a color image-forming substance is incorporated into a fogged emulsion while a negative type silver halide emulsion layer comprising a compound capable of releasing a development inhibitor is used as an adjacent layer to be fogged emulsion layer.

An image-receiving element which mordants a diffusible dye being transferred by diffusion from a light-sensitive element may be suitably selected according to the object as will be described later.

The image-receiving element and the light-sensitive element may be coated either on the same support, or on different supports. In the latter case, as a support for the image-receiving element, there may be used, according to the object, various materials similar to those used as supports for the light-sensitive element. The support for the image-receiving element may also be either transparent or opaque.

The image-receiving element must have indispensably an image-receiving layer containing a mordant, that is an image-receiving layer. As mordants suitable for use in the image-receiving layer of image-receiving element, there may be used any mordants so long as they have preferable mordant effect on a diffusible dye being transferred by diffusion from the light-sensitive element. However, such mordants, for example, as poly-4-vinylpyridine, poly-4-vinyl-N-benzylpyridinium-paratoluene sulfonate, cetyltrimethyl ammonium bromide and the like are useful for the purpose. Such mordants as disclosed in U.S. Pat. No. 2,882,156 and Belgian Pat. No. 729,202 may be advantageously usable in the present invention. As a dispersant for the above-mentioned mordants, there may be used various materials such as gelatin and polyvinyl alcohol.

As a special case, furthermore, a mordant can be incorporated into an alkaline processing solution in the manner as described in Japanese Laid-Open-to-Public publication No. 47,626/1975.

The diffusible dye being transferred by diffusion to the image-receiving element may not be a dye, per se, but may be a leuco dye or dye precursor. In such a case, it is advantageous that the image-receiving element is incorporated, for example, with an oxidizing agent, a color developing agent or a diazonium compound in order to convert such leuco dye or dye precursor into the corresponding dye. Usable as the image-receiving elements containing such oxidizing agent, color developing agent or diazonium compound, are those disclosed in U.S. Pat. Nos. 2,647,049; 3,676,124 and 2,698,798; Japanese Laid-Open-to-Public publication No. 80,131/1975; and French Patent No. 2,235,776. As disclosed in French Pat. Nos. 2,235,776 and 2,232,777; and Japanese Laid-Open-to-Public publication No. 104,023/1975, it is also possible that an oxidizing agent is made present in an alkaline processing solution which will be mentioned later.

After substantial completion of the formation of a dye image, wherein the diffusible dye has been transferred by diffusion to the image-receiving layer of the image-receiving element by application of the alkaline processing solution, it is necessary that the pH in a film unit is decreased to the vicinity of neutral pH so as to increase the transferred diffusible dye in stability and, at the same time, to prevent a further formation of dye image, in fact, and to prevent image discoloration or staining which may be caused at high pH. For this reason, a neutralization layer containing a substance capable of sufficiently lowering the pH is advantageously incorporated into the image-receiving element. As the substance used in the neutralization layer for this purpose, for example, such polymer acid as disclosed in U.S. Pat. No. 3,362,819 or its partial ester or acid anhydride, or such higher fatty acids as disclosed in U.S. Pat. No. 2,983,606, or each solid acid metal salts as disclosed in U.S. Pat. No. 2,584,030 are useful for the present invention.

Furthermore, the pH-lowering substance may be formed into microcapsules in the manner as described in U.S. Pat. No. 3,576,625.

The neutralization layer explained above is generally incorporated into the image-receiving element, but said layer can be incorporated into either the light-sensitive element or both elements.

Further, a spacer layer is preferably used in the image-receiving element in order to control a lowering speed of the pH. For the preparation of such spacer layer, there may be used such materials as gelatin, hydroxypropyl cellulose, patially hydrolyzed polyvinyl acetate acryl latex, polyacrylamide and mixture thereof.

In addition thereto, the image-receiving element may be incorporated with various additives commonly used in the art of photography, such as ultraviolet absorbers, fluorescent brightening agents and the like.

An alkaline processing solution used in the present invention contains ingredients necessary for development of a silver halide and formation of a diffusible dye. It has a strong alkalinity which is generally pH 10 or higher.

The alkaline processing solution used in the present invention contains a hydroxide of alkali metals or alkaline earth metals, for example, sodium hydroxide, potassium hydroxide, calcium hydroxide and lithium hydroxide, or sodium carbonate or diethylamine. The processing solution may also be incorporated with such development inhibitors as benzotriazole, and further with such compound which is used as a viscosity-increasing agent as hydroxyethyl cellulose, sodium salt of carboxymethyl cellulose or the like.

In the case of color diffusion transfer process of the dye developer type according to the present invention, the alkaline processing solution is desirably incorporated with such onium compound as quaternary ammonium salt. Typical examples of the particularly useful onium compound are, for example, 1-benzyl-2-picolinium bromide and 1-phenethyl-2-picolinium bromide, and such onium compounds as disclosed in U.S. Pat. Nos. 3,411,904 and 3,173,786 are also usable in the present invention.

In the aforementioned second mode of process where an oxidized product formed during development of a silver halide reacts with a non-diffusible coupler which is a color image-forming substance, thereby to release a diffusible dye and form a color image in the presence of an aromatic primary amine, the alkaline processing solution used therein contains such a developing agent as an aromatic primary amine. In this process, additives for alkaline processing solution disclosed in Japanese patent publications Nos. 21,778/1968 and 17,184/1966 and Japanese Laid-Open-to-Public publication No. 325/1972 are useful for the present invention.

In the aforementioned third mode of process using a non-diffusible dye-releasing redox compound, the alkaline processing solution desirably contains a silver halide developing agent. Typical examples of the silver halide developing agent are hydroquinone, 1-phenyl-3-pyrazolidone, 1-phenyl-4,4-dimethyl-3-pyrazolidone, 1-phenyl-4-methyl-4-hydroxymethyl-3-pyrazolidone, p-aminophenol, N-methyl-p-aminophenol, N,N-diethyl-p-phenylenediamine, 3-methyl-N,N-diethyl-p-phenylenediamine, 3-methoxy-N-ethyl-N-ethoxy-p-phenylenediamine and the like.

In the aforementioned fourth mode of process, the alkaline processing solution contains such silver halide developing agent as shown above.

The processing solution may further contain titanium dioxide as a light reflecting agent. As the method of reflecting light behind the image-receiving layer, there may be employed such methods as disclosed in Japanese Laid-Open-to-Public publications Nos. 486/1971 and 477/1972. The processing solution may also be incorporated with, as opacifying agents, carbon black or such indicator dyes as disclosed in Japanese Laid-Open-to-Public publication Nos. 26/1972; 27/1972 and 28/1972. Further, such desensitizers as disclosed in U.S. Pat. No. 3,579,333 may be advantageously usable in the processing solution.

The alkaline processing solution of the present invention is advantageously stored in a rupturable container.

It is also possible to incorporate such development inhibitor as 1-phenyl-5-mercaptotetrazole or benzylamino purine into any one of the light-sensitive element, image-receiving element and processing solution.

In the dye developer process, it is also advantageous to incorporate an auxiliary developing agent, for example, such hydroquinone derivatives as p-tolylhydroquinone, catechol derivative or Phenidone into any one of the light-sensitive element, image-receiving element and processing solution. Such auxiliary developing agents as disclosed in Japanese patent publication No. 17,383/1960; U.S. Pat. Nos. 2,939,788; 3,192,044 and 3,462,266; British Pat. No. 1,243,539; Japanese Laid-Open-to-Public publications Nos. 40,128/1974; 83,440/1974; 84,238/1974 and 6,340/1975 may be advantageously usable in the present invention. The auxiliary developing agent may be incorporated into the light-sensitive element or image-receiving element according to a procedure similar to that employed in dispersing the color image-forming substance as aforesaid. The auxiliary developing agent may also be incorporated in a homogeneous state into the image-receiving element in the manner as disclosed in Japanese Laid-Open-to-Public publication No. 131,134/1974.

In a film unit used in the present invention, the light-sensitive element, prior to exposure to light, may be present apart from the image-receiving element, or both elements may be combined in one united body. After development treatment, the light-sensitive element may be kept still combined with the image-receiving element in one united body, or the two elements may be peeled off from each other. Any of such film units as disclosed in U.S. Pat. Nos. 3,415,644; 3,415,645; 3,415,646; 3,473,925; 3,573,042; 3,594,164; 3,594,165 and 3,615,421, Belgian Pat. No. 757,959 or 757,960 may also usable in the present invention.

In the present invention, it is a characteristic feature that the aforementioned alkaline processing solution is then applied to both the exposed light-sensitive element and the image-receiving element placed upon the light-sensitive element, in the presence of the above-mentioned compound of the general formula [I].

As typical examples of the compound of the general formula [I], there may be mentioned as follows:

Hexamethylphosphoramide

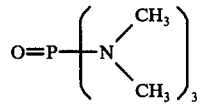

(1)

N,N-dimethylformamide

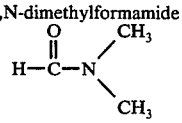

(2)

N,N-diethylformamide

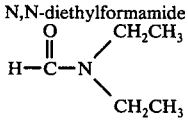

(3)

-continued

N,N-dimethylpropionamide (4)

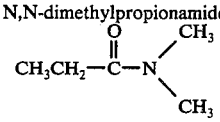

N,N-dimethylacetamide (5)

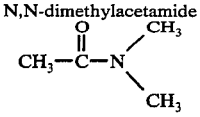

N,N-diethylacetamide (6)

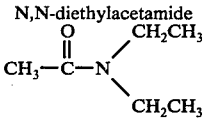

N,N,N',N'-tetramethylurea (7)

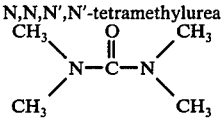

N-methyl-γ-lactum (8)

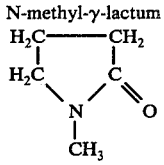

The compounds of the aforementioned general formula [I] give very good results by incorporating the same in the film unit, preferably in at least one of the light-sensitive element, the image-receiving element and the alkaline processing solution, prior to the application of the solution to the both elements.

In case the aforementioned compound is incorporated into the alkaline processing solution, the amount of the compound to be used is generally 0.1 to 20% by volume, preferably from 1 to 10% by volume, based on the alkaline processing solution.

In case said compound is incorporated into the light-sensitive element, the compound may be incorporated into any one of a silver halide emulsion layer, a layer containing a color image-forming substance, an intermediate layer and a protective layer, or may be incorporated into two or more of these layers.

Further, it may be incorporated into either any one of the layers in the image-receiving element or two or more of said layers, and it may also be incorporated into the layer or layers in both the light-sensitive and image-receiving elements. Still further, it is possible to use a combination of two or more compounds of the aforementioned general formula in either the light-sensitive element or the image-receiving element, or in both elements.

The amount of the compound of the present invention to be incorporated into the light-sensitive element or the image-receiving element may vary depending on the kinds of compound used and on the layers into which the compound used is incorporated. Generally, however, the present compound is used in an amount of 1.0 to 400 ml, preferably 25.0 to 250 ml, based on 100 g of silver halide used.

For the incorporation of the compound of the aforementioned general formula [I], there may be adopted various procedures, for example, the compound is previously incorporated into a coating liquid or liquids for forming a layer or layers in either the light-sensitive element or the image-receiving element or in both elements and then the coating liquid or liquids are applied to either one or both elements, or the compound is coated, as it is, on the previously coated light-sensitive or image-receiving element, or the compound diluted with a solvent such as water is coated on or sprayed over the previously coated light-sensitive or image-receiving element.

In case the compound of the formula [I] is incorporated into the light-sensitive element or the image-receiving element, it is preferable that the compound is previously incorporated into the silver halide layer, the layer adjacent thereto or the layer containing the color image-forming substance, and more preferable is the case wherein the light-sensitive element comprises the silver halide emulsion layer not containing the color image-forming substance and the adjacent or neighboring layer thereto containing the color image-forming substance, and the compound of the formula [I] is incorporated into the emulsion layer. Since, in the case of tricolor photography, by properly incorporating the compound of formula [I] into one or two of the emulsion layer or the neighboring layer thereof, an adequate balance between maximum densities and transfer rates of three colors can be maintained. Particularly in the case of using a film unit of type wherein the light-sensitive element is peeled off from the image-receiving element after the development treatment, this advantage is enhanced so that the processing time latitude can be increased.

In the first mode of process using the dye developer, the maximum density of the image obtained increases when the compound of formula [I] is incorporated in the emulsion layer, in comparison with in the processing solution. In the other three modes, however, the maximum density is substantially equal in each case, that is, in the emulsion layer or in the processing solution.

The present invention is illustrated below with reference to examples, but the invention is not intended to be limited thereto.

EXAMPLE 1

Light-sensitive elements [A], [B] and [C] were prepared respectively by coating the following layers successively in the manner mentioned below on an acetylcellulose film support subbed on the surface with gelatin.

[Light-sensitive Element A]

(1) Cyan dye developer layer 1,4-bis(α-Methyl-β-hydroxynonylpropylamino)-5,8-dihydroxyanthraquinone was dissolved in a mixture of N-n-butylacetanilide and 4-methylcyclohexanone and the resulting solution was emulsified by dispersing it in an aqueous gelatin solution containing Alkanol B. The emulsified dispersion was coated on the support so that the amount of gelatin became 4.2 g/m$^2$ and that of the cyan dye developer 2.0 g/m$^2$ in the resultant layer.

(2) Red-sensitive emulsion layer

A red-sensitive silver iodobromide emulsion containing 40 ml of hexamethylphosphoramide per 100 g of silver was coated on the cyan dye developer layer so that the amount of silver became 0.6 g/m$^2$ and that of gelatin 2.4 g/m$^2$ in the resultant layer.

(3) Intermediate layer

Gelatin was coated on the red-sensitive emulsion layer so that the amount of gelatin became 2.0 g/m² in the resultant layer.

(4) Magenta dye developer layer

2-[p-(β-hydroxynonylethyl)phenylazo]-4-n-propoxy-1-naphthol was dissolved in a mixture of N-n-butylacetanilide and 4-methylcyclohexanone and the resulting solution was emulsified by dispersing it in an aqueous gelatin solution containing a dispersing agent Alkanol B. The emulsified dispersion was coated on the intermediate layer so that the amount of gelatin became 2.8 g/m² and that of the magenta dye developer 1.3 g/m² in the resultant layer.

(5) Green-sensitive emulsion layer

A green-sensitive silver iodobromide emulsion containing 40 ml of hexamethylphosphoramide per 100 g of silver was coated on the magenta dye developer layer so that the amount of silver became 1.2 g/m² and that of gelatin 1.2 g/m² in the resultant layer.

(6) Intermediate layer

Gelatin was coated on the green-sensitive emulsion layer so that the amount of gelatin became 1.5 g/m² in the resultant layer.

(7) Yellow dye developer layer

1-Phenyl-3-N-n-hexylcarboxyamido-4-(p-2',5'-dihydroxyphenethylphenylazo)-5-pyrazolone was dissolved in a mixture of N,N-diethyllaurylamide and ethyl acetate and the resulting solution was emulsified by dispersing it in an aqueous gelatin solution containing Alkanol B. The emulsified dispersion was coated on the intermediate layer so that the amount of gelatin became 1.1 g/m² and that of the yellow dye developer 0.5 g/m² in the resultant layer.

(8) Blue-sensitive emulsion layer

A blue-sensitive silver iodobromide emulsion containing 40 ml of hexamethylphosphoramide per 100 g of silver was coated on the yellow dye developer layer so that the amount of silver became 0.6 g/m² and that of gelatin 0.5 g/m² in the resultant layer.

(9) Protective layer

A solution of 4'-methylphenylhydroquinone in N,N-diethyllaurylamide was emulsified by dispersing it in an aqueous gelatin solution to prepare a coating liquid. Into 100 ml of the thus prepared coating liquid was incorporated 5 ml of a 2% mucochloric acid and the resulting mixture was then coated on the blue-sensitive emulsion layer so that the amount of 4'-methylphenylhydroquinone became 0.5 g/m² and that of gelatin 0.6 g/m² in the resultant layer.

[Light-sensitive Element B]

The same procedure as in the case of the light-sensitive element [A] was repeated, except that dimethylformamide was used in the red-sensitive, green-sensitive and blue-sensitive emulsion layers in place of the hexamethylphosphoramide incorporated into the corresponding emulsion layers in the light-sensitive element [A].

[Light-sensitive Element C]

The same procedure as in the case of the light-sensitive element [A] was repeated, except that the hexamethylphosphoramide incorporated into the red-sensitive, green-sensitive and blue-sensitive emulsion layers in the light-sensitive element [A] was omitted from the corresponding emulsion layers in the light-sensitive element [C].

The light-sensitive elements thus obtained were individually exposed to light through an optical wedge using red, green and blue filters. Each of the exposed light-sensitive elements was placed on an image-receiving element mentioned later and the resulting united body was subjected to development treatment using the following processing solution.

| Processing solution: | |
|---|---|
| Water | 100 ml |
| Potassium hydroxide | 4.5 g |
| Carboxymethylcellulose | 3.5 g |
| Benzotriazole | 3.0 g |
| N-Phenethyl-α-picolinium bromide | 2.0 g |

Image-receiving Element

One part of poly-4-vinylpyridine and 2 parts of polyvinyl alcohol were dissolved in a mixture of ½ part of glacial acetic acid and 150 parts of water. The resulting solution was further charged with 1/20 part of 1-phenyl-5-mercaptotetrazole and then coated on a baryta paper to prepare the image-receiving element.

After the lapse of a 45-second processing, the light-sensitive element was peeled off from the image-receiving element. The maximum density (Dmax) and minimum density (Dmin) of each of the dye images obtained on the image-receiving element were measured using red, green and blue filters. Further, in the case of the light-sensitive element [C] which has been peeled off from the image-receiving element after the lapse of a 90-second processing, the measurement of Dmax and Dmin was likewise conducted. The results obtained were as shown in Table 1.

Table 1

| Light-sensitive element | Processing time (sec) | Dmax | | | Dmin | | |
|---|---|---|---|---|---|---|---|
| | | Blue | Green | Red | Blue | Green | Red |
| A | 45 | 2.25 | 2.28 | 2.19 | 0.26 | 0.23 | 0.20 |
| B | 45 | 2.16 | 2.20 | 2.17 | 0.25 | 0.24 | 0.19 |
| C | 45 | 1.76 | 1.68 | 1.60 | 0.23 | 0.23 | 0.19 |
| C | 90 | 2.02 | 1.99 | 1.96 | 0.24 | 0.23 | 0.17 |

From the results shown in Table 1, it is understood that when the light-sensitive elements [A] and [B] according to the present invention are processed using the same processing time as in the case of the light-sensitive element [C], the respective Dmax values of the formed images greatly increase as compared with that of the light-sensitive element [C]. Further, it is understood that when the light-sensitive element [C] is processed, the processing time necessary for obtaining an image density substantially equal to those obtained by the processing of the light-sensitive elements [A] and [B] of the present invention becomes twice that required in the case of the present light-sensitive elements [A] and [B], and that in accordance with the present invention, the processing time can be greatly shortened.

EXAMPLE 2

Light-sensitive elements [D], [E] and [F] were respectively prepared by coating the following layers successively in the manner as mentioned below on an acetylcellulose film support subbed on the surface with gelatin.

[Light-sensitive Element D]

(1) Magenta dye developer layer

1 Gram of 2- p-(2',5'-dihydroxyphenylethyl)-phenylazo-4-n-propoxy-1-acetoxynaphthalene was added to 30 ml of ethanol and filtered to remove matter insoluble in ethanol. The resulting solution was added to 125 ml of water to precipitate the dye developer. The precipitate was collected by filtration and the collected mass was washed with water. Thereafter, an aqueous slurry containing 7% by weight of the dye developer and 10% of Alkanol B based on the dye developer was formed. The slurry was subjected to ultrasonic wave dispersion using a ultrasonic wave homogenizer and then dispersed in gelatin. The thus obtained dispersion was coated on the support so that the amount of gelatin became 2.8 g/m$^2$ and that of the dye developer 1.4 g/m$^2$ in the resultant layer.

(2) Green-sensitive emulsion layer

A solution of 4'-methylphenylhydroquinone in N,N-diethyllaurylamide was emulsified by dispersing it in an aqueous gelatin solution. A green-sensitive silver iodobromide emulsion in corporated with the thus obtained dispersion was coated on the magenta dye developer layer so that the amount of silver became 1.2 g/m$^2$, that of 4'-methylphenylhydroquinone 0.15 g/m$^2$ and that of gelatin 1.3 g/m$^2$ in the resultant layer.

(3) Protective layer

A mixture of 100 ml of a 5% gelatin solution, 3 ml of N,N-dimethylacetamide and 5 ml of a 2% mucochloric acid was coated on the green-sensitive emulsion layer so that the amount of gelatin became 0.6 g/m$^2$.

[Light-sensitive Element E]

The same procedure as in the case of the light-sensitive element [D] was repeated, except that N-methyl-γ-lactam was used in the protective layer in place of the N,N-dimethylacetamide used in the corresponding layer in the light-sensitive element [D].

[Light-sensitive Element F]

The same procedure as in the case of the light-sensitive element [D] was repeated, except that the N,N-dimethylacetamide used in the protective layer in the light-sensitive element [D] was omitted from the corresponding layer in the light-sensitive element [F].

An image-receiving element was prepared by successively coating the following layers on an acetylcellulose film support.

(1) Neutralization layer

A partial butyl ester of a polyethylene/maleic anhydride copolymer obtained by refluxing for 14 hours 300 g of highly viscous(ethylene/maleic anhydride), 140 g of n-butyl alcohol and 1 ml of a 85% phosphoric acid was coated on the support so that the resulting layer came to have a thickness of 19μ.

(2) Spacer layer

An aqueous solution of hydroxypropylcellulose was coated on the neutralization layer so that the resulting layer came to have a thickness of 1.9μ.

(3) Image-receiving layer

A mixture of 1 part of poly-4-vinylpyridine and 2 part of polyvinyl alcohol was coated on the spacer layer so that the resulting layer came to have a thickness of 10μ.

The image-receiving element thus obtained was placed on the above-mentioned light-sensitive elements, and the resulting united body was exposed to light through an optical wedge from the image-receiving element side using a green filter. The exposed united body was then subjected to development treatment using the following processing solution and the image-receiving element was measured, without being peeled off from the light-sensitive element, in reflection density. The results obtained were as shown in Table 2.

| Processing solution | |
|---|---|
| Water | 100 ml |
| Potassium hydroxide | 11.2 g |
| Carboxymethylcellulose | 3.5 g |
| Benzotriazole | 3.0 g |
| N-Phenethyl-α-picolinium bromide | 2.0 g |
| Titanium dioxide | 40.0 g |

Table 2

| Light-sensitive element | Dmax | Dmin |
|---|---|---|
| [D] | 2.24 | 0.16 |
| [E] | 2.33 | 0.18 |
| [F] | 1.64 | 0.14 |

As is clear from Table 2, it is understood that when the light-sensitive elements [D] and [E] according to the present invention are used, their respective maximum densities increase.

EXAMPLE 3

An image-receiving element was prepared in the same manner as in Example 2, except that the image-receiving layer as prepared in Example 2 was further incorporated with hexamethylphosphoramide. The amount of hexamethylphosphoramide used in the image-receiving layer was so controlled as to be 0.3 ml/m$^2$.

The image-receiving element thus obtained and the light-sensitive element obtained in Example 2 were subjected, according to the same manner as in Example 2, to exposure and development treatment, and the image-receiving element was measured in reflection density. The results obtained were as shown in Table 3.

Table 3

| Dmax | Dmin |
|---|---|
| 2.20 | 0.15 |

As is clear from the results shown in Table 3 and those of the image-receiving element [F] shown in Table 2, it is understood that even when the compound of the present invention is incorporated into the image-receiving element, the maximum density increases.

EXAMPLE 4

Light-sensitive elements [G] and [H] were respectively prepared in the following manner using an acetylcellulose film as a support.

[Light-sensitive Element G]

2-{p-[(4-hydroxy-2-pentadecyl)-benzenesulfoneamide]-phenylazo}-3,6-disulfo-8-acetamide-naphthol monopyridinium salt was dissolved in a mixture of water and ethanol and the resulting solution was incorporated into a silver iodobromide emulsion. The silver iodobromide emulsion was coated on the support so that the amount of silver became 1 g/m$^2$, that of gelatin 4.6 g/m$^2$ and that of the color image-forming substance 2-(p-[(4-hydroxy-2-pentadecyl)-benzenesulfoneamido]-phenylazo)-3,6-disulfo-8-acetamido-naphthol monopyridium salt 1 g/m$^2$.

Subsequently, a mixture of 100 ml of a 5% aqueous gelatin solution, 3 ml of N,N-dimethylformamide and 5 ml of a 2% mucochloric acid was coated on the silver iodobromide emulsion layer so that the amount of gelatin became 0.6 g/m$^2$ in the resultant layer.

[Light-Sensitive Element H]

The light-sensitive element [H] was prepared in the same manner as in the case of the light-sensitive element [G], except that the N,N-dimethylformamide was omitted from the mixture used in the case of the light-sensitive element [G]. An image-receiving element was prepared by coating a mixture of gelatin and N-α-octadecyltri-butylammonium bromide on an acetylcellulose film support subbed on the surface with gelatin so that the amount of gelatin became 7 g/m$^2$ and that of N-α-octadecyltri-butylammonium bromide 1.5 g/m$^2$ in the resultant layer.

Each of the above-mentioned light-sensitive elements was exposed to light through an optical wedge. The exposed light-sensitive element was then placed on the image-receiving element and the resulting united body was treated with the following processing solution.

| Composition of processing solution: | |
|---|---|
| Water | 100 ml |
| Phenidone | 0.05 g |
| Sodium hydroxide | 4.0 g |
| Sodium sulfite | 12.6 g |
| Hydroxyethylcellulose | 3.0 g |

Afer the lapse of a 45-second processing, the image-receiving element was peeled off from the light-sensitive element and the maximum density (Dmax) and minimum density (Dmin) of a magenta image formed on the image-receiving element were measured. The results obtained were as shown in Table 4.

Table 4

| Light-sensitive element | Dmax | Dmin |
|---|---|---|
| [G] | 1.63 | 0.19 |
| [H] | 1.21 | 0.18 |

As is clear from Table 4, it is understood that when the light-sensitive element [G] according to the present invention is used, the maximum density of the magenta image formed increases.

EXAMPLE 5

[Light-Sensitive Element I]

A light-sensitive element [I] was prepared in the same procedure as in the case of the light-sensitive element [A] prepared in Example 1, except that 1,5-bis-(4'-β-hydroxynonylphenylanilino)-4,8-dihydroxyanthraquinone was used in place of the 1,4-bis(α-methyl-β-hydroxynonylamino)-5,8-dihydroxyanthraquinone used in the cyan dye developer layer in the light-sensitive element [A].

[Light-Sensitive Element J]

A light-sensitive element [J] was prepared in the same manner as in the case of the light-sensitive element [I], except that the amount of hexamethylphosphoramide incorporated into the red-sensitive emulsion layer in the light-sensitive element [I] was changed to 60 ml per 100 g of silver.

Each of the light-sensitive elements thus obtained was exposed to light through an optical wedge using red, green and blue filters, and the exposed light-sensitive element was subjected, using the same image-receiving element and same processing solution as in Example 1, to development treatment.

After the lapse of a 45-second processing, the image-receiving element was peeled off from the light-sensitive element, and the maximum density (Dmax) and minimum density (Dmin) of each dye image formed on the image-receiving element were measured using red, green and blue filters. The results obtained were as shown in Table 5.

Table 5

| Light-sensitive element | Dmax | | | Dmin | | |
|---|---|---|---|---|---|---|
| | Blue | Green | Red | Blue | Green | Red |
| [I] | 2.25 | 2.28 | 1.98 | 0.25 | 0.24 | 0.19 |
| [J] | 2.26 | 2.29 | 2.26 | 0.25 | 0.25 | 0.20 |

From the results shown in Table 5, it is understood that the maximum densities of three colors can be kept in adequate balance by varying the amount of hexamethylphosphoramide used.

EXAMPLE 6

A light-sensitive element was prepared by successively coating the following layers on an acetylcellulose film support which had been subbed on the surface with gelatin.

(1) Cyan dye developer layer

A solution of 1,4-bis(α-methyl-β-hydroxynonylpropylamino)-5,8-dihydroxyanthraquinone in a mixture of N-n-butylacetanilide and 4-methyl-cyclohexanone was emulsified by dispersing it in an aqueous gelatin solution containing Alkanol B. The emulsified dispersion was coated on the support so that the amount of gelatin became 4.2 g/m$^2$ and that of the cyan dye developer 2.0 g/m$^2$ in the resultant layer.

(2) Red-sensitive emulsion layer

A red-sensitive silver iodobromide emulsion was coated on the cyan dye developer layer so that the amount of silver became 0.6 g/m$^2$ and that of gelatin 2.4 g/m$^2$ in the resultant layer.

(3) Intermediate layer

The red-sensitive emulsion layer was coated on the surface with gelatin to form an intermediate layer thereon so that the amount of gelatin became 2.0 g/m$^2$ in the resultant layer.

(4) Magenta dye developer layer

A solution of 2- [p-(β-hydroxynonylethyl)-phenylazo]-4-n-propoxy-1-naphthol in a mixture of N-n-butylacetanilide and 4-methylcyclohexanone was emulsified by dispersing it in an aqueous gelatin solution containing a dispersing agent Alkanol B. The emulsified dispersion was coated on the intermediate layer so that the amount of gelatin became 2.8 g/m$^2$ and that of the magenta dye developer 1.3 g/m$^2$ in the resultant layer.

(5) Green-sensitive emulsion layer

A green-sensitive silver iodobromide emulsion was coated on the magenta dye developer layer so that the amount of silver became 1.2 g/m$^2$ and that of gelatin 1.2 g/m$^2$ in the resultant layer.

(6) Intermediate layer

The green-sensitive emulsion layer was coated on the surface with gelatin to form an intermediate layer thereon so that the amount of gelatin became 1.5 g/m$^2$ in the resultant layer.

(7) Yellow dye developer layer

A solution of 1-phenyl-3-N-n-hexylcarboxyamide-4-[p-(2',5'-dihydroxyphenethyl)phenylazo]-5-pyrazolone in a mixture of N,N-diethyllaurylamide and ethyl acetate solvent was emulsified by dispersing it in an aqueous gelatin solution containing Alkanol B. The emulsified dispersion was coated on the intermediate layer so that the amount of gelatin became 1.1 g/m$^2$ and that of the yellow dye developer 0.5 g/m$^2$ in the resultant layer.

(8) Blue-sensitive emulsion layer

A blue-sensitive silver iodobromide emulsion was coated on the yellow dye developer layer so that the amount of silver became 0.6 g/m$^2$ and that of gelatin 0.6 g/m$^2$ in the resultant layer.

(9) Protective layer

A solution of 4'-methylphenylhydroquinone in N,N-diethyllaurylamide was emulsibied by dispersing it in an aqueous gelatin solution to prepare a coating liquid. Into 100 ml of the coating liquid thus prepared was incorporated 5 ml of a 2% mucochloric acid and the resulting mixture was coated on the blue-sensitive emulsion layer so that the amount of 4-methylphenylhydroquinone became 0.5 g/m$^2$ and that of gelatin 0.6 g/m$^2$ in the resultant layer.

The light-sensitive element thus prepared was exposed to light through an optical wedge using red, green and blue filters. The exposed light-sensitive element was then placed on an image-receiving element which will be described later and the resulting unit was subjected to development processing using any one of the following processing solutions [A], [B] and [C].

Processing Solution [A]

| | |
|---|---|
| Water | 100 ml |
| Potassium hydroxide | 4.5 g |
| Carboxymethylcellulose | 3.5 g |
| Benzotriazole | 3.0 g |
| N-Phenethyl-α-picolinium bromide | 2.0 g |
| N,N,N',N'-tetramethylurea | 5 ml |

Processing Solution [B]

This processing solution had the same composition as in the processing solution [A], except that dimethylformamide was used in place of the N,N,N',N'-tetramethylurea used in the processing solution [A].

Processing Solution [C]

This processing solution had the same composition as in the processing solution [A], except that the N,N,N',N'-tetramethylurea used in the processing solution [A] was excluded therefrom.

Image-Receiving element

A solution of 1 part of poly-4-vinylpyridine and 2 parts of polyvinyl alcohol in a mixture of ½ part of glacial acetic acid and 150 parts of water was charged with 1/20 part of 1-phenyl-5-mercaptotetrazole and the resulting mixture was coated on a baryta paper to prepare an image-receiving element.

After the lapse of a 45-second processing, the light-sensitive element was peeled off from the image-receiving element. Dmax and Dmin of each of the dye images formed respectively on the image-receiving elements were measured using red, green and blue filters. In the case where the processing solution [C] was used, a further measurement of Dmax and Dmin of a dye image formed was conducted by peeling off the light-sensitive element from the image-receiving element after the lapse of 90-second processing. The results obtained were as shown in Table 6.

Table 6

| Processing solution | Processing time (sec.) | Dmax | | | Dmin | | |
|---|---|---|---|---|---|---|---|
| | | Blue | Green | Red | Blue | Green | Red |
| A | 45 | 2.08 | 2.13 | 2.10 | 0.25 | 0.20 | 0.18 |
| B | 45 | 2.05 | 2.10 | 2.07 | 0.23 | 0.18 | 0.15 |
| C | 45 | 1.72 | 1.65 | 1.53 | 0.22 | 0.15 | 0.12 |
| C | 90 | 1.98 | 2.06 | 2.10 | 0.24 | 0.15 | 0.13 |

From the results shown in Table 6, it is understood that in case the film unit is processed with the processing solution [A] as well as with the processing solution [B] of the present invention, the respective Dmax values of the dye images formed thereby greatly increase as compared with the case of the processing solution [C] when the same processing time is employed. Furthermore, it is understood that when the processing solution [C] is used, the processing time necessary for obtaining an image density substantially equal to that obtained by the use of the processing solution [A] as well as [B] of the present invention becomes twice that required in the case of the processing solution [A] as well as [B] and thus the processing time can be greatly shortened according to the present invention.

EXAMPLE 7

A light-sensitive element was prepared by successively coating the following layers on an acetylcellulose film support which had been subbed on the surface with gelatin.

(1) Magenta dye developer layer

A solution of 2-[p-(2',5'-dihydroxyhenylethyl)-phenylazo]-4-n-propoxy-1-acetoxynaphthalene in a mixture of N,N-diethyllaurylamide and ethyl acetate was emulsified by dispersing in an aqueous gelatin solution containing a dispersing agent Alkanol B. The emulsified dispersion was coated on the support so that the amount of gelatin became 2.8 g/m$^2$ and that of the dye developer 1.4 g/m$^2$ in the resultant layer.

(2) Green-sensitive emulsion layer

A green-sensitive silver iodobromide emulsion was coated on the magenta dye developer layer so that the amount of silver became 1.2 g/m$^2$ and that of gelatin 1.3 g/m$^2$ in the resultant layer.

(3) Protective layer

A solution of 4'-methylphenylhydroquinone in N,N-diethyllaurylamide was emulsified by dispersing it in an aqueous gelatin solution to prepare a coating liquid. Into 100 ml of the coating liquid thus prepared was incorporated 5 ml of 2% mucochloric acid and the resulting mixture was coated on the green-sensitive emulsion layer so that the amount of 4'-methylphenylhydroquinone became 0.2 g/m$^2$ and that of gelatin 0.6 g/m$^2$.

An image-receiving element was prepared by successively coating the following layers on an acetylcellulose film support.

(1) Neutralization layer

A partial butyl ester of a polyethylene/maleic anhydride copolymer was prepared by refluxing for 14 hours a mixture of 300 g of highly viscous poly(ethylene/-maleic anhydride), 140 g of n-butyl alcohol and 1 ml of a 85% phosphoric acid. The partial butyl ester thus prepared was coated on the support so that the resulting layer came to have a film thickness of 19μ.

(2) Spacer layer

An aqueous solution of hydroxypropylcellulose was coated on the neutralization layer so that the resulting layer came to have a film thickness of 1.9μ.

(3) Image-receiving layer

A mixture of 1 part of poly-4-vinylpyridine and 2 parts of polyvinyl alcohol was coated on the spacer layer so that the resulting layer came to have a film thickness of 10μ.

The image-receiving element thus prepared was placed on the aforementioned light-sensitive element to form a film unit and the film unit thus formed was exposed to light through an optical wedge from the side of the image-receiving element using a green filter. The exposed film unit was then subjected to development processing using any one of the following processing solutions [D], [E] and [F]. Reflection density of the image-receiving element was then measured without peeling off said image-receiving element from the light-sensitive element in the processed film unit. The results obtained were as shown in Table 7.

Processing Solution [D]

| | |
|---|---|
| Water | 100 ml |
| Potassium hydroxide | 11.2 g |
| Carboxymethylcellulose | 3.5 g |
| Benzotriazole | 3.0 g |
| N-Phenethyl-α-picolinium bromide | 2.0 g |
| Titanium dioxide | 40.0 g |
| Hexamethylphosphoryl amide | 5 ml |

Processing Solution [E]

This processsing solution had the same composition as in the processing solution [D], except that N,N-dimethylacetamide was used in place of the hexamethylphosphoryl amide used in the processing solution [D].

Processing Solution [F]

This processing solution had the same composition as in the processing solution [D], except that the hexamethylphosphoryl amide used in the processing solution [D] was excluded therefrom.

Table 7

| Processing solution | Dmax | Dmin |
|---|---|---|
| [D] | 2.15 | 0.19 |
| [E] | 2.08 | 0.17 |
| [F] | 1.53 | 0.13 |

As is clear from Table 7, it is understood that when the film unit is processed with the processing solution [D] as well as [D] of the present invention, their respective values of Dmax increase.

EXAMPLE 8

A light-sensitive element was prepared by successively coating the following layers on one side of a polyethylene terephthalate film support of 110μ in thickness and covered on another side with an opaque layer containing gelatin (45 mg/100 cm²) and carbon black (25 mg/100 cm²):

(1) Magenta image forming substance layer of 1.4μ in thickness, containing a magenta non-diffusible redox compound (10.0 mg/100 cm²) having the formula

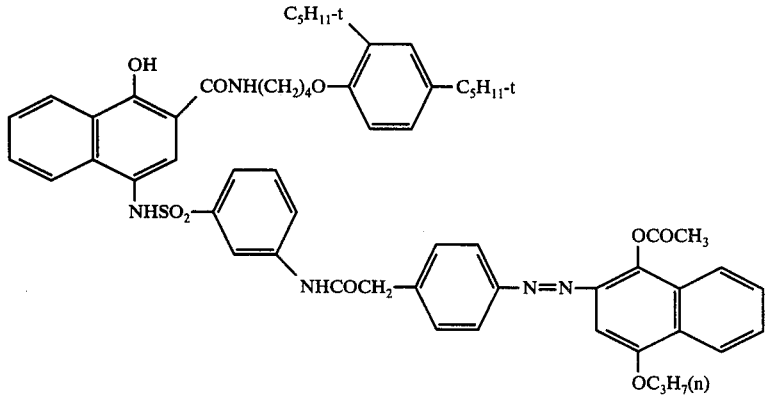

Colloidal palladium (0.05 mg/100 cm¹²) and gelatin (18.0 mg/100 cm²);

(2) Intermediate layer of 0.9μ in thickness, containing 2,5-di-tert.-octylhydroquinone (2.2 mg/100 cm²), di-n-butylphthalate (2.2 mg/100 cm²) and gelatin (11.0 mg/100 cm²);

(3) Green-sensitive emulsion layer of 2.2μ in thickness, containing a green-sensitive silver iodide emulsion (16.0 mg silver/100 cm²), 2,5-di-tert.-octylhydroquinone (12.0 mg/100 cm²), di-n-butylphthalate (12.0 mg/100 cm²) and gelatin (24.0 mg/100 cm²);

(4) Protective layer of 0.9μ in thickness, consisting of gelatin (10.0 mg/100 cm²).

In the preparation of the above light-sensitive element, the magenta non-diffusible redox compound gelatin dispersion was prepared as follows:

The above redox compound was dissolved in acetone. The solution was filtered and the filtered solution was dropped into 125 ml water to precipitate the above redox compound. Then, Alkanol XC (Sodium tri-isopropyl naphthalenesulfonate produced by Du Pont) was added therein to form an aqueous slurry containing the above redox compound (7% by weight) and Alkanol XC (10% of the weight of the redox compound). The aqueous slurry was dispersed in gelatin by the use of an ultrasonic homogenizer.

An image-receiving element was prepared by successively coating the following layers on a transparent polyethylene terephthalate film support of 100μ in thickness.

(1) Neutralization layer of 25.0μ in thickness consisting of polyacrylate (24.8 mg/100 cm²);

(2) Spacer layer of 3.0μ in thickness consisting of cellulose acetate (5.0 mg/100 cm²);

(3) Image-receiving layer of 2.0μ in thickness containing a copolymer (1 : 1) of styrene and N-benzyl- N,N-dimethyl-N-(3-maleimidepropyl)ammonium chloride (22.0 mg/100 cm²) and gelatin (22.0 mg/100 cm²).

The image-receiving element thus prepared was placed on the light-sensitive element above, and the resulting united body was exposed to light from the image-receiving element side. The exposed united body was subjected to development treatment using the following solution [G] or [H].

Processing Solution [G]

| | |
|---|---|
| Potassium hydroxide | 45.0 g |
| Sodium sulphite | 2.0 g |
| 1-Phenyl-3-pyrazolidone | 8.0 g |
| 5-Methylbenzotriazole | 2.8 g |
| Sodium thiosulphate | 5.0 g |
| Carboxymethyl cellulose sodium salt | 50.0 g |
| Titanium dioxide | 500.0 g |
| Hexamethylphosphoramide | 50 ml |
| Distilled water to make | 1000 ml |

Processing Solution [H]

This processing solution had the same composition as in the proccessing solution [G], except that hexamethylphosphoramide was excluded therefrom.

After 10 minutes, positive magenta dye image was obtained. Dmax and Dmin of the magenta dye image were as shown in Table 8.

Table 8

| Processing solution | Dmax | Dmin |
|---|---|---|
| [G] | 2.04 | 0.23 |
| [H] | 1.76 | 0.21 |

As is clear from Table 8, it is understood that when the processing solution of the present invention is used, their respective value of Dmax increases.

EXAMPLE 9

A light-sensitive element [K] was prepared by coating the following layers successively on a transparent polyester film support.

(1) Image-receiving layer consisting of 3.8 g/m² of octadecyl trimethyl ammonium methyl sulphate and 9.6 g/m² of gelatin;

(2) Reflection layer consisting of 48.4 g/m² of $TiO_2$ and 4.8 g/m² of gelatin;

(3) Intermediate layer consisting of 2.7 g/m² of gelatin;

(4) Magenta color image-forming substance layer having incorporated therein, together with silver sulphide grains, and 0.87 g/m² of the following compound

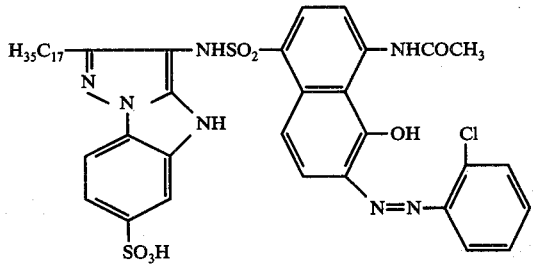

and 2.80 g/m² of gelatin;

(5) Green-sensitive silver bromide emulsion layer of 0.68 g/m² of AgBr, 0.85 g/m² of octadecyl hydroquinone sulphonic acid, 0.25 g/m² of octadecyl hydroquinone and 1.8 g/m² of gelatin;

(6) Protective layer consisting of 2.5 g/m² gelatin.

A light sensitive-element [L] was prepared by the same procedure as in the case of the light-sensitive element [K] except that 3 ml/m² of N,N-dimethylacetamide was used in the green-sensitive silver bromide emulsion layer in the light-sensitive element [K].

Each of the light-sensitive elements [K] and [L] was exposed to light through an optical wedge, covered on the layer side with an opaque polyester sheet, and then subjected to development treatment using the following processing solution [I].

Processing Solution [I]

| | |
|---|---|
| Water | 100 ml |
| Sodium hydroxide | 2.5 g |
| Phenidone | 0.1 g |
| Sodium thiosulphate | 0.2 g |
| Sodium sulphite | 0.4 g |
| Paraformaldehyde | 0.1 g |
| Hydroxyethyl cellulose | 3.0 g |

After ten minutes, a positive magenta dye image was obtained.

The same procedure as described above was repeated, using the light sensitive element [K] and the following processing solution [J].

Processing Solution [J]

| | |
|---|---|
| Water | 100 ml |
| Sodium hydroxide | 2.5 g |
| Phenidone | 0.1 g |
| Sodium thiosulphate | 0.2 g |
| Sodium sulphite | 0.4 g |
| Paraformaldehyde | 0.1 g |
| N,N-dimethylacetamide | 5 ml |
| Hydroxyethyl cellulose | 3.0 g |

After ten minutes, a positive magenta image was obtained.

Dmax and Dmin of the dye images were as shown in Table 9.

Table 9

| Light-sensitive element | Processing solution | Dmax | Dmin |
|---|---|---|---|
| [K] | I | 1.53 | 0.60 |
| [L] | I | 1.82 | 0.61 |
| [K] | J | 1.83 | 0.61 |

As is clear from the results shown in Table 9, it is understood that when the light-sensitive element [L] or the processing composition [J] according to the present invention was used, the maximum density increases.

What we claim is:

1. In a process for forming a dye image in an image-receiving layer of a film unit containing a light-sensitive element and an image-receiving element, the light-sensitive element having a silver halide emulsion layer in combination with a diffusible dye image forming substance, an intermediate layer and a protective layer, the image-receiving element containing an image-receiving layer, wherein the light-sensitive element is exposed to light and then subjected to an alkaline processing solution and a silver halide developing agent whereby a diffusible dye is formed in the light-sensitive element, said diffusible dye then being diffusion transfered from the light-sensitive element to the image-receiving layer superposed thereon to form the dye image in the image-receiving layer, the improvement comprising providing at least one member selected from the group consisting of the silver halide emulsion layer, the intermediate layer, the protective layer, the image-receiving layer and the alkaline processing solution with a compound represented by the formula;

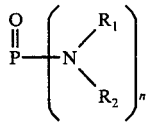

wherein $R_1$ and $R_2$ individually represent lower alkyl, and $n$ is 3.

2. A process according to claim 1, wherein the compound is present in at least one of the silver halide emulsion layer, the intermediate layer, the protective layer, and the image-receiving layer in an amount of 1.0 to 400 ml per 100 g of silver halide.

3. A process according to claim 1, wherein the compound is present in the alkaline processing solution in an amount of 0.1 to 20% by volume.

4. The process according to claim 1 wherein the diffusible dye image-forming substance is selected from the group consisting of a diffusible dye developer capable of developing silver halide to change its diffusibility in the alkaline processing solution; a non-diffusible coupler capable of releasing a chromophore moiety by coupling reaction with an oxidized color developing agent or by intramolecular ring-closing reaction subsequent to the coupling reaction; a non-diffusible redox compound capable of releasing a chromophore moiety by being oxidized to undergo an intramolecular ring-closing reaction; and a non-diffusible compound capable of releasing a chromophore moiety by cleaving in the alkaline solution and capable of reacting with an oxidized developing agent before the releasing to lower the rate of the releasing.

5. A process according to claim 1, wherein the diffusible dye image-forming substance is the dye developer.

6. A process according to claim 1, wherein the diffusible dye image-forming substance is a non-diffusible redox compound capable of releasing a chromophore moiety by being oxidized by an oxidized developing agent to cleave.

7. In a process for forming a dye image in an image-receiving layer of a film unit containing a light-sensitive element and an image receiving element, the light-sensitive element having a silver halide emulsion layer in combination with a diffusible dye image forming substance, an intermediate layer and a protective layer, the image-receiving element containing an image-receiving layer, wherein the light-sensitive element is exposed to light, and then subjected to an alkaline processing solution and a silver halide developing agent whereby a diffusible dye is formed in the light-sensitive element, said diffusible dye then being diffusion transfered from the light-sensitive element to the image-receiving layer superposed thereon to form the dye image in the image-receiving layer, the improvement comprising providing at least one member selected from the group consisting of the silver halide emulsion layer, the intermediate layer, the protective layer, the image-receiving layer and the alkaline processing solution with a compound represented by the formula:

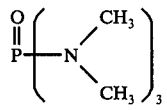

8. A process according to claim 7, wherein the compound is present in at least one of the silver halide emulsion layer, the intermediate layer, the protective layer, and the image-receiving layer in an amount of 1.0 to 400 ml per 100 g of silver halide.

9. A process according to claim 7, wherein the compound is present in the alkaline processing solution in an amount of 0.1 to 20% by volume.

10. The process according to claim 7 wherein the diffusible dye image-forming substance is selected from the group consisting of a diffusible dye developer capable of developing silver halide to change its diffusibility in the alkaline processing solution; a non-diffusible coupler capable of releasing a chromophore moiety by coupling reaction with an oxidized color developing agent or by intramolecular ring-closing reaction subsequent to the coupling reaction; a non-diffusible redox compound capable of releasing a chromophore moiety by being oxidized to cleave in the alkaline processing solution or by being oxidized to undergo an intermolecular ring-closing reaction; and a non-diffusible compound capable of releasing a chromophore moiety by cleaving in the alkaline solution and capable of reacting with an oxidized developing agent before the releasing to lower the rate of the releasing.

11. A process according to claim 7, wherein the diffusible dye image-forming substance is the dye developer.

12. A process according to claim 7, wherein the diffusible dye image-forming substance is a non-diffusible redox compound capable of releasing a chromophore moiety by being oxidized by an oxidized developing agent to cleave.

* * * * *